US007140894B2

(12) United States Patent
Tsai

(10) Patent No.: US 7,140,894 B2
(45) Date of Patent: Nov. 28, 2006

(54) METALLIC SLIDING SLOT STRUCTURE FOR AN ELECTRICAL CONNECTOR

(76) Inventor: Chou Hsuan Tsai, 15F, No. 4, Lanes 127, Sec. 1, Fu-Hsing Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 11/195,161

(22) Filed: Aug. 2, 2005

(65) Prior Publication Data

US 2006/0166531 A1 Jul. 27, 2006

(51) Int. Cl.
*H01R 13/62* (2006.01)

(52) U.S. Cl. ..... 439/159

(58) Field of Classification Search ..... 439/159, 439/155, 152

See application file for complete search history.

(56) References Cited

U.S. PATENT DOCUMENTS 6,033,244 A * 3/2000 Nishioka ..... 439/159
6,036,513 A * 3/2000 Nishioka ..... 439/159
6,039,587 A * 3/2000 Oguchi ..... 439/159
6,042,401 A * 3/2000 Oguchi et al. ..... 439/159
6,059,589 A * 5/2000 Nishioka ..... 439/159
6,406,311 B1 * 6/2002 Yu ..... 439/159
6,482,020 B1 * 11/2002 Yeh ..... 439/159
6,835,077 B1 * 12/2004 Ikeda et al. ..... 439/159
7,018,222 B1 * 3/2006 Chang ..... 439/159
2002/0052132 A1 * 5/2002 Sato ..... 439/159
2002/0127899 A1 * 9/2002 Ikeda et al. ..... 439/159
2003/0119350 A1 * 6/2003 Chen ..... 439/159
2003/0124890 A1 * 7/2003 Harasawa et al. ..... 439/159
2003/0139077 A1 * 7/2003 Sasaki et al. ..... 439/159
2004/0038570 A1 * 2/2004 He ..... 439/159
2004/0127079 A1 * 7/2004 Nagata ..... 439/159
2005/0101170 A1 * 5/2005 Tanaka et al. ..... 439/159
2005/0277319 A1 * 12/2005 Kodera et al. ..... 439/159

* cited by examiner

*Primary Examiner*—Tulsidas C. Patel
*Assistant Examiner*—Nguyen Phuongchi
(74) *Attorney, Agent, or Firm*—Pro-Techtor Int'l Services

(57) ABSTRACT

A metallic sliding slot structure for an electrical connector, which includes a base in which the slot structure formed by folding and pressing a metallic plate is positioned. The slot structure includes a bottom plate, an inner track plate disposed above the bottom plate, an outer track plate having an opening for enclosing the inner track plate, and at least one one-way block formed by pressing the bottom plate. The inner track plate has one end formed with a tip and the other end formed into an M-like shape to form a concave first positioning point. A one-way circulation path is formed between the inner and outer track plates. A second positioning point corresponding to the tip is defined in the opening of the outer track plate. The path goes from the second positioning point to the first positioning point and then back to the second positioning point.

20 Claims, 19 Drawing Sheets

METALLIC SLIDING SLOT STRUCTURE FOR AN ELECTRICAL CONNECTOR

BACKGROUND OF THE INVENTION

1. Field of the Invention

The invention relates to a metallic sliding slot structure, and more particularly to a metallic sliding slot structure for an electrical connector.

2. Description of the Related Art

A card-in/out device capable of hiding and positioning an inserted card and exposing an ejected card has been widely used in electrical products and computer peripheral products. The card may be, for example, a multimedia storage card or a memory card. The available memory cards for computers have several specifications and include a secure digital card (SDC), a multimedia card (MMC), a smart media card (SMC), a memory stick card (MSC), an XD-picture card (XDC), and the like.

The connector, which is to be connected to the inserted memory card and capable of hiding and positioning the inserted memory card and exposing the ejected memory card, is provided with a card-in/out device, as shown in FIGS. 1 and 2. The connector includes a base 10, terminals 25, a pushing piece 20, a guiding rod 26 and a spring 28.

The base 10 includes a bottom seat 11 and an upper cover 19 covering over the bottom seat 11. As shown in FIG. 3, the bottom seat 11 is made of plastic injection molding and is formed with a receiving slot 18 for receiving one memory card with a variable specification. One side of the receiving slot 18 is one-piece molded to form a heart-like sliding slot 12. One end of the slot 12 is formed with a starting point 13, and the other end of the slot is formed with a stroke point 14, a middle concave positioning point 15 and a card-out starting point 16. The sliding slot 12 is formed with several sloped blocks 7, as illustrated by hatched portions. Thus, a one-way circulation path from the starting point 13 to the stroke point 14, the positioning point 15, the card-out starting point 16 and the starting point 13 is created.

The terminals 25 are arranged in several rows and disposed on the bottom seat 11.

The pushing piece 20 having an inverse U-shape includes two sides pushing against two sides of the receiving slot 18 on the bottom seat 11. A connection hole 21 is formed at a front end of one side of the pushing piece 20.

Two ends of the guiding rod 26 are formed with longitudinal hooks 27 for hooking the connection hole 21 of the pushing piece 20 and the sliding slot 12 of the bottom seat 11, respectively.

The spring 28, which is disposed between the pushing piece 20 and a rear end of the bottom seat 11, provides an elastic force for moving the pushing piece 20, which moves toward the inside of the base 10, back to the original position.

According to the above-mentioned structure, the pushing piece 20 pushed by the inserted memory card drives the guiding rod 26 to slide in the sliding slot 12. Because the sliding slot 12 has a one-way circulation path, the guiding rod 26 is pushed from the starting point 13 to the stroke point 14 and then pulled back to the positioning point 15 and positioned at the positioning point 15 by the elastic force of the spring when the memory card is inserted. When the card is ejected, the memory card is also pushed, and the guiding rod 26 is pushed from the positioning point 15 to the card-out starting point 16 and then pulled back to the starting point 13 by the elastic force of the spring. Thus, the card in/out function can be achieved.

The conventional structure has the following drawbacks. Because the sliding slot 12 and the bottom seat 11 are formed by way of plastic injection molding, the shape of the sliding slot 12 and the sloped blocks 7 tend to be worn out to cause the sliding phenomena after several times of usage. Thus, the positioning points are unclear, or the positioning points cannot provide the function of effectively positioning, or the one-way circulation function disappears, thereby the electrical connector cannot work. In addition, the plastic material has poor intensity and the thickness has to be increased to enhance the intensity. So, the area of the sliding slot is enlarged, and the demand on the miniaturized electrical product cannot be met.

In addition, in order to enhance the long-lived property, some manufacturers adopt the metal casting method to integrally form the metallic sliding slot structure. However, this method has the following drawbacks. First, the manufacturing cost of metal casting is high. Second, the metal casting method cannot easily control the precise dimension and tends to form burrs and unsmooth surfaces, and is not suitable for the manufacturing of the precise elements.

SUMMARY OF THE INVENTION

It is therefore an object of the invention to provide a metallic sliding slot structure for an electrical connector, wherein the slot structure can withstand the wear, damage or sliding condition and thus ensure the reliability in usage.

Another object of the invention is to provide a metallic sliding slot structure for an electrical connector, wherein the slot structure is formed by pressing and folding a metallic plate in a simple and low-cost manner.

Still another object of the invention is to provide a metallic sliding slot structure for an electrical connector, wherein the slot structure is formed by pressing and folding a metallic plate such that the overall area is small and the overall size is miniaturized as compared to that formed by way of plastic molding.

To achieve the above-mentioned objects, the invention provides a metallic sliding slot structure for an electrical connector. The electrical connector includes a base in which the metallic sliding slot structure is positioned. The metallic sliding slot structure is formed by folding and pressing a metallic plate. The metallic sliding slot structure includes a bottom plate, an inner track plate disposed above the bottom plate, an outer track plate having an opening for enclosing the inner track plate, and at least one one-way block formed by pressing the bottom plate. The inner track plate has one end formed with a tip and the other end formed into an M-like shape to form a concave first positioning point. A circulation path is formed between the inner and outer track plates, and a second positioning point corresponding to the tip of the inner track plate is defined in the opening of the outer track plate. The circulation path goes from the second positioning point to the first positioning point and then back to the second positioning point to form a one-way circulation.

According to the above-mentioned structure, the metallic sliding slot structure is formed by pressing and folding a metallic plate. So, the precision in manufacturing may be easily controlled in a simple and low-cost manner. In addition, the product can withstand the wear, damage or sliding condition and thus ensure the reliability in usage.

Other objects, features, and advantages of the invention will become apparent from the following detailed description of the preferred but non-limiting embodiments. The following description is made with reference to the accompanying drawings.

DETAILED DESCRIPTION OF THE INVENTION

Figure 1:
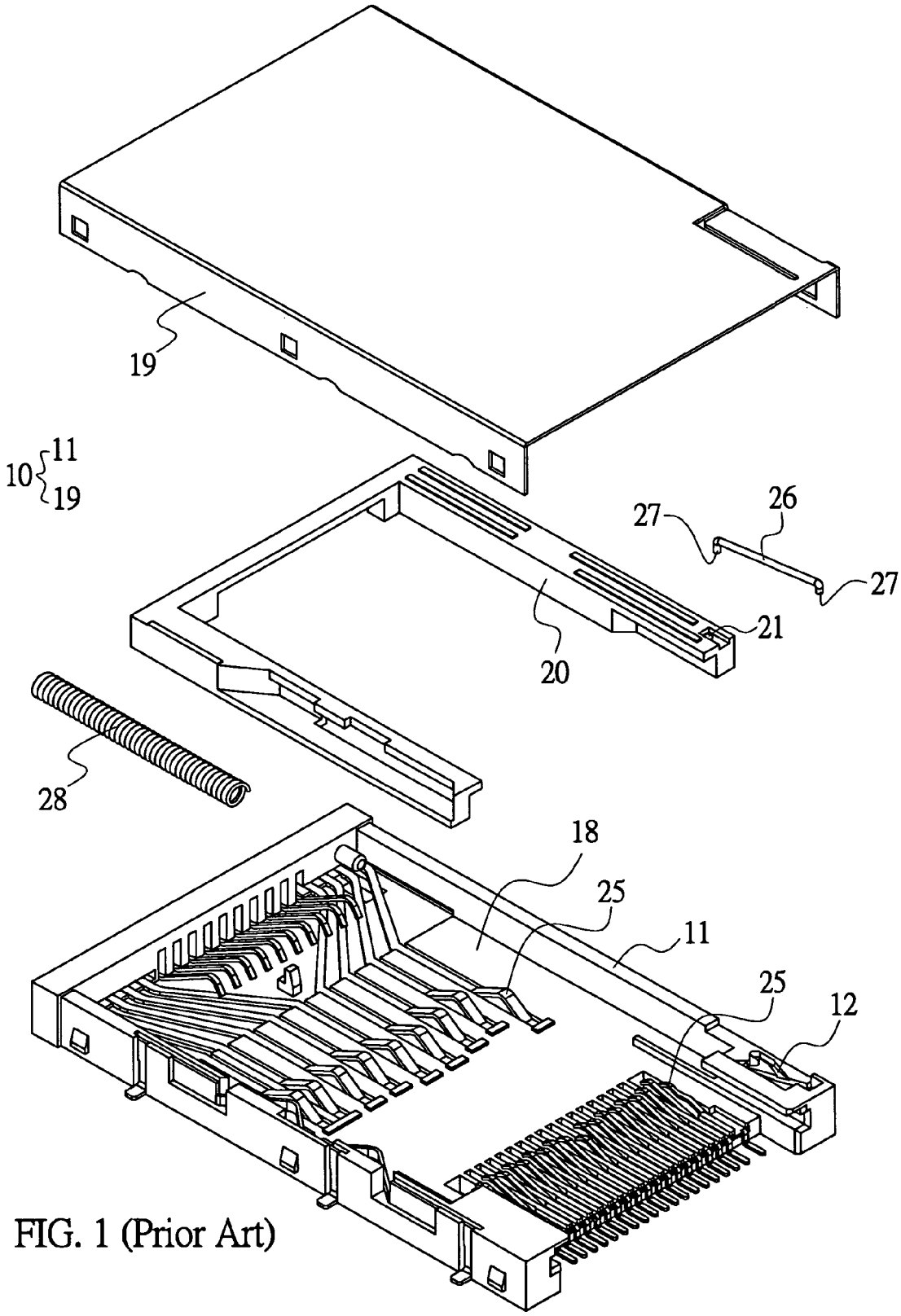
FIG. 1 (Prior Art)
FIG. 1 is a pictorially exploded view showing a conventional electrical connector.
Figure 2:
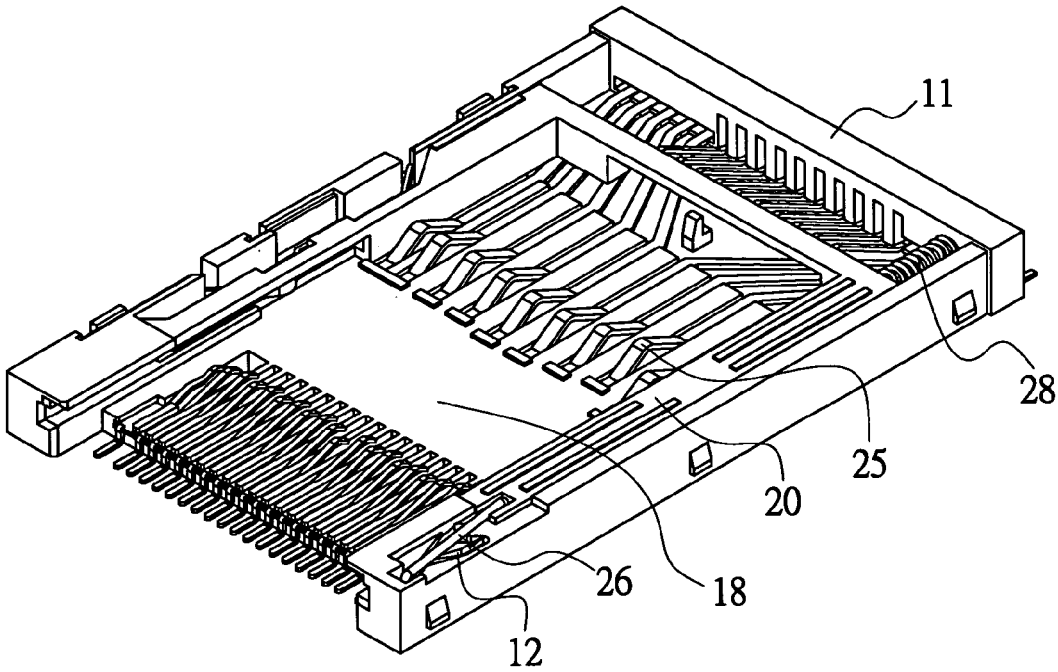
FIG. 2 (Prior Art)
FIG. 2 is a pictorially assembled view showing the conventional electrical connector without an upper cover.
Figure 3:
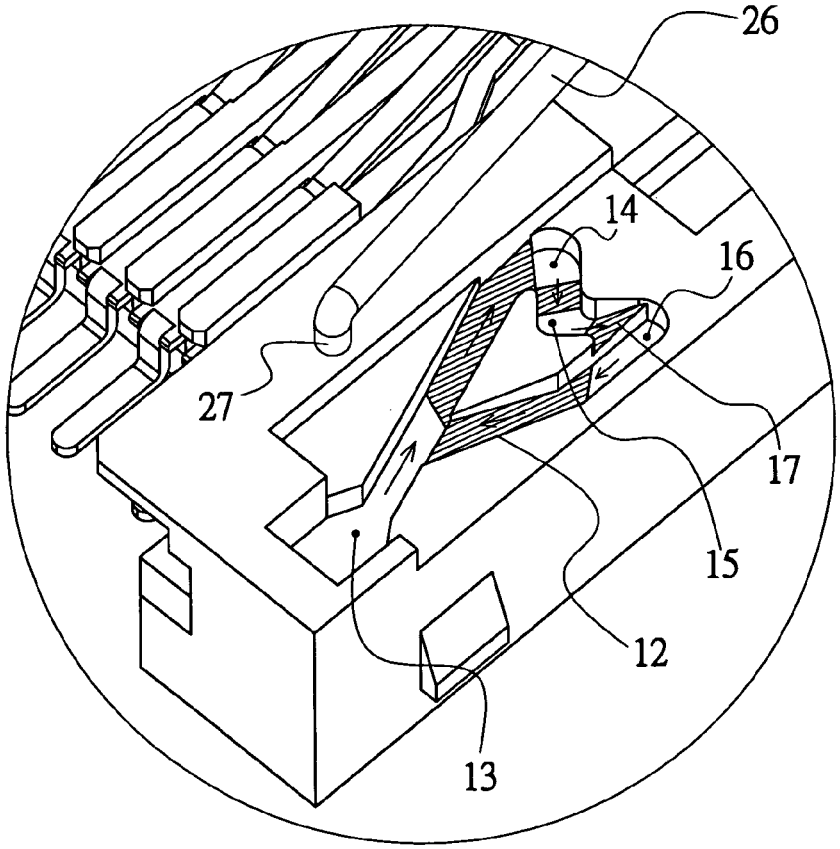
FIG. 3 (Prior Art)
FIG. 3 is a pictorial view showing a sliding slot of the conventional electrical connector.
Figure 4:
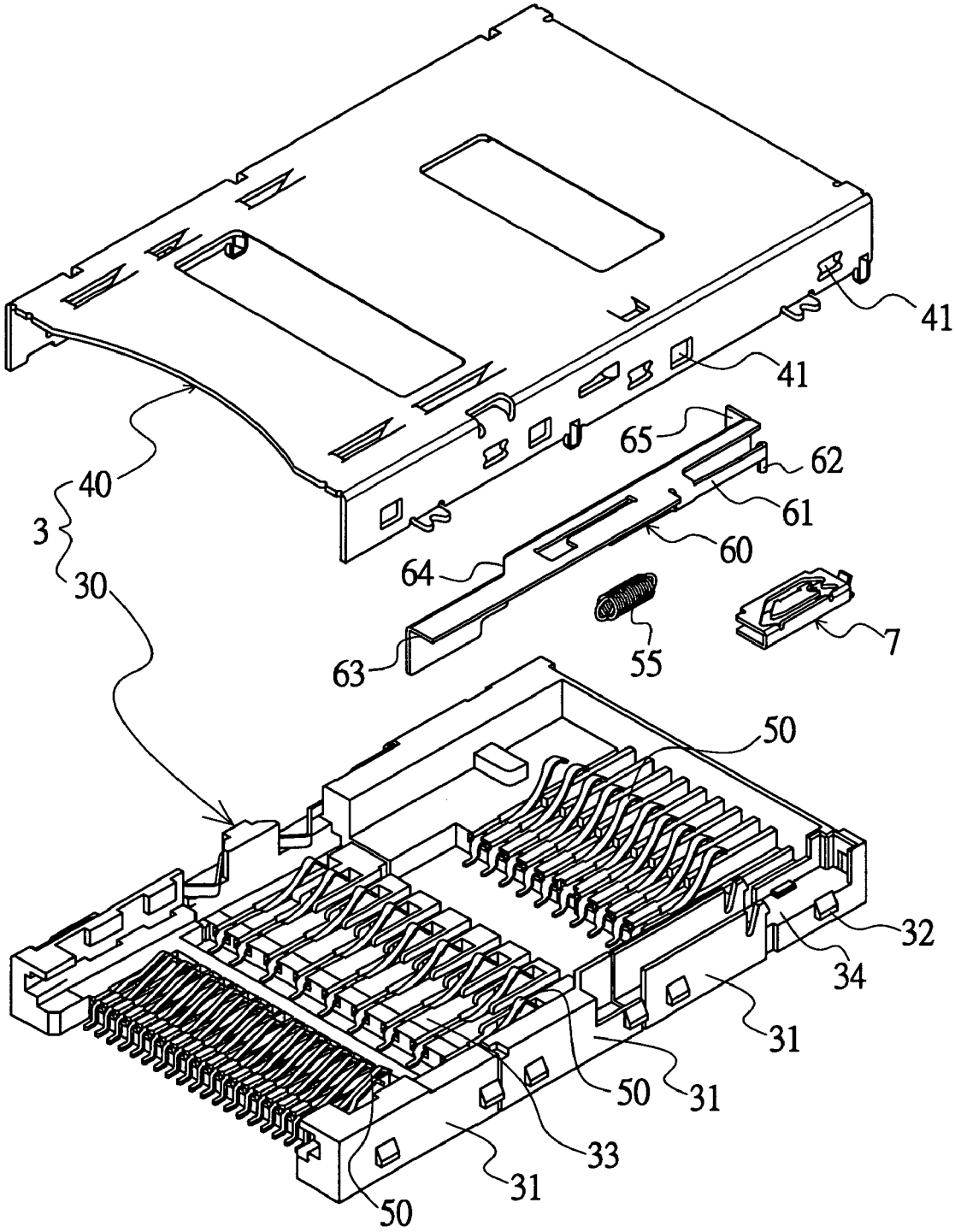
FIG. 4 is a pictorially exploded view showing a first embodiment of the invention.
Figure 5:
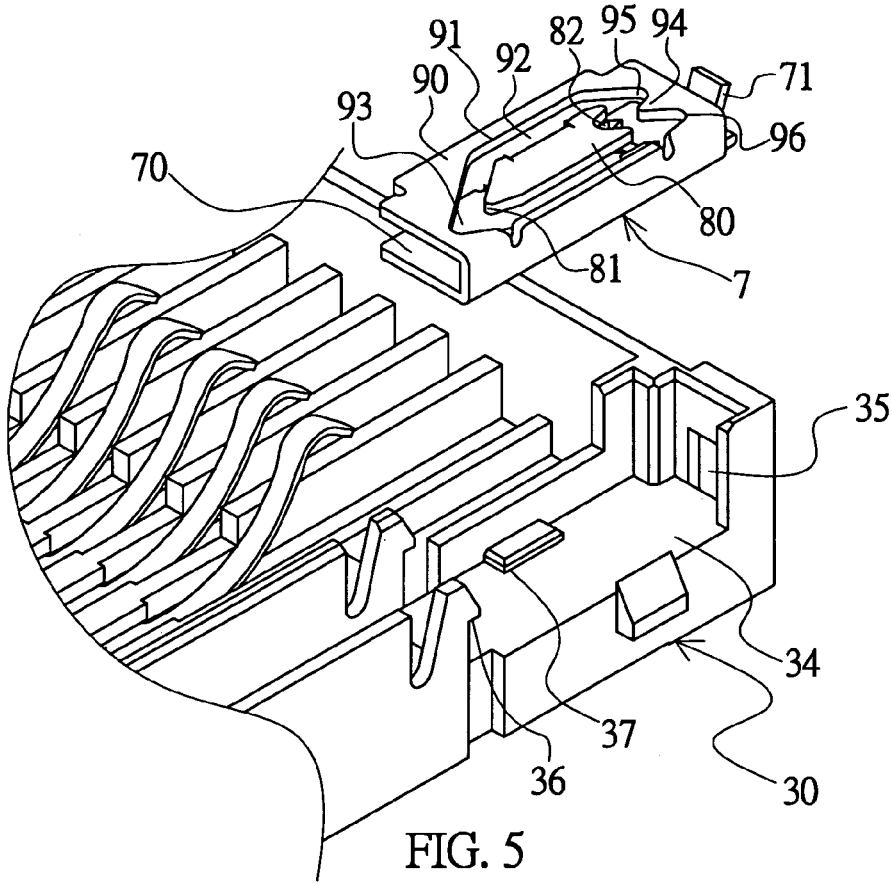
FIG. 5 is a pictorially exploded view showing a metallic sliding slot structure and an allocation slot according to the first embodiment of the invention.
Figure 6:
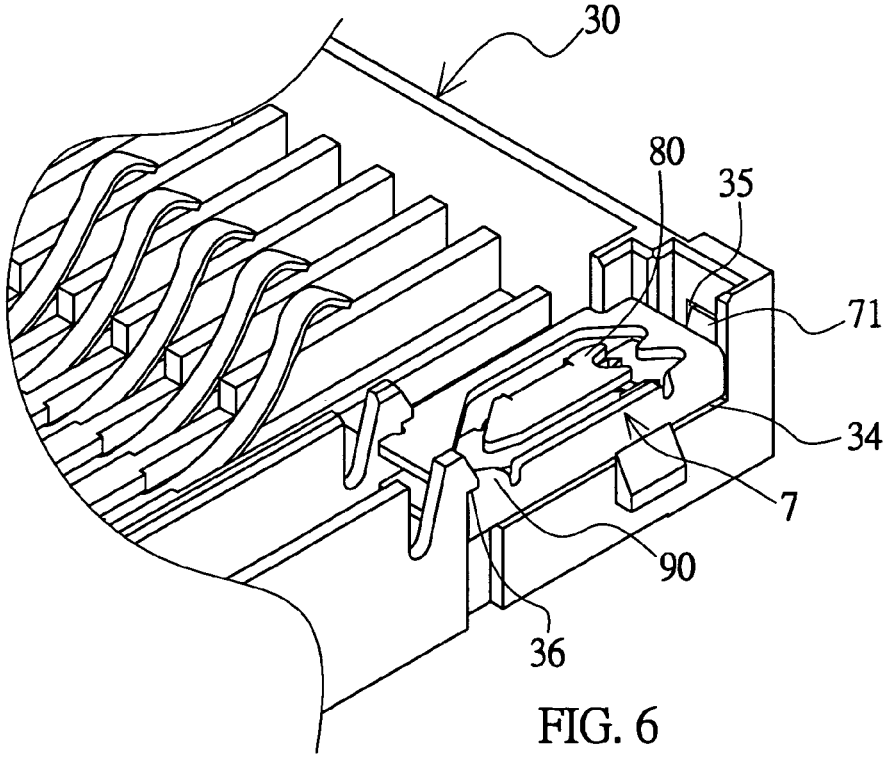
FIG. 6 is a pictorially assembled view showing the metallic sliding slot structure and the allocation slot according to the first embodiment of the invention.
Figure 7:
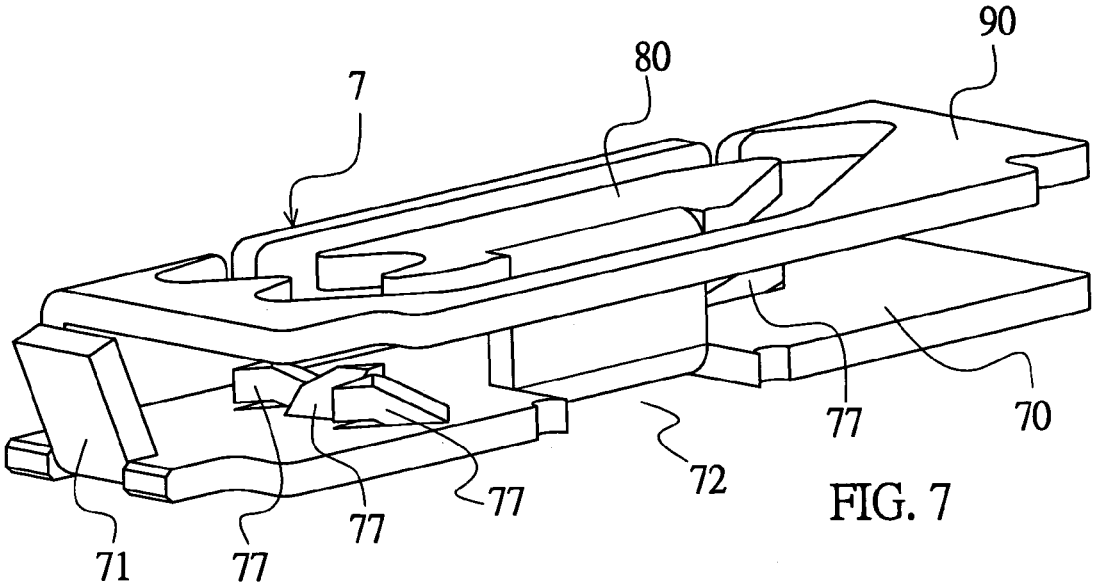
FIG. 7 is a pictorial view showing the metallic sliding slot structure according to the first embodiment of the invention.
Figure 8:
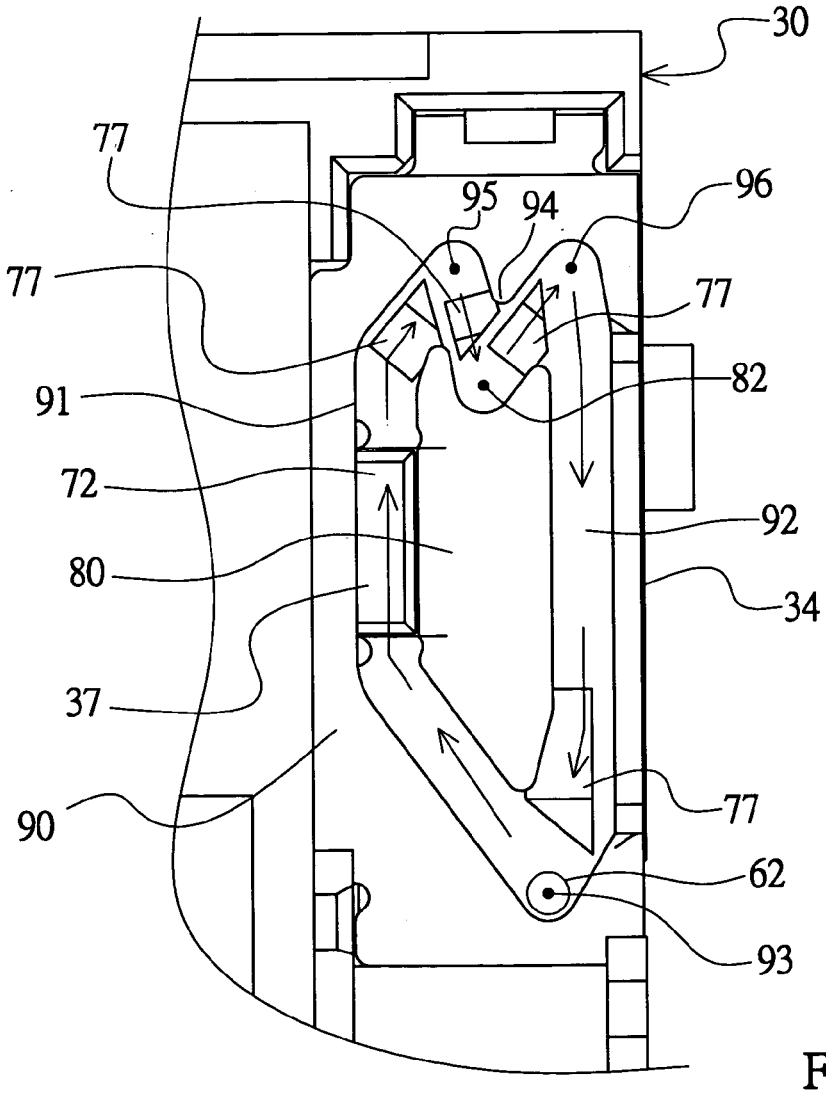
FIG. 8 is a top view showing the metallic sliding slot structure and the allocation slot according to the first embodiment of the invention.

Referring to FIG. 4, the electrical connector of this embodiment, which is a memory card connector capable of being connected to various memory cards with different specifications, includes a base 3, terminals 50, a metallic sliding slot structure 7, a pushing piece 60 and a spring 55.

The base 3 includes a bottom seat 30 and an upper cover 40 covering over the bottom seat 30. The bottom seat 30 is composed of three child seats 31 with different shapes. Two sides of each of the child seats 31 have engagement blocks 32 to be engaged with engagement holes 41 formed at two sides of the upper cover 40, respectively. The bottom seat 30 has a receiving slot 33 capable of receiving a memory card with a changeable specification. One side of the rear child seat 31 is formed with an allocation slot 34.

The terminals 50 are arranged on the three child seats 31.

The pushing piece 60 may be positioned in the upper cover 40 to slide back and forth on the inner surface of the upper cover 40. The function of the pushing piece 60 is not the important feature of this invention, so detailed descriptions thereof will be omitted. An elastic rod 61 is formed at a side of the rear end of the pushing piece 60. The front end of the elastic rod 61 is formed with a longitudinal guiding rod 62 fit into the metallic sliding slot structure 7 to slide therein. The pushing piece 60 has first, second and third pushing portions 63, 64 and 65 to be pushed by the memory cards with different specifications.

Two ends of the spring 55 are connected to the pushing piece 60 and the upper cover 40. The spring 55 provides an elastic force for moving the pushing piece 60, which has been moved into the base, back to the original position.

As shown in FIGS. 5 to 8, the metallic sliding slot structure 7 is positioned in the allocation slot 34 of the bottom seat 30 and is integrally formed by pressing and folding a metallic plate. The metallic sliding slot structure 7 includes a bottom plate 70, an inner track plate 80, an outer track plate 90 and multiple one-way blocks 77.

The rear wall of the allocation slot 34 is formed with a first slot 35. Two sides of the front end of the allocation slot 34 are formed with engagement surfaces 36. The bottom surface of the allocation slot 34 is formed with a projection 37.

The rear end of the bottom plate 70 is formed with a slantingly engagement sheet 71.

The inner track plate 80 is formed by tearing one side of the bottom plate 70 and folding the torn portion at a height into a horizontal state above the bottom plate 70, such that the bottom plate 70 is formed with a notch 72. The inner track plate 80 has one end formed with a tip 81 and the other end formed into an M-like shape to form a concave first positioning point 82.

The outer track plate 90 is formed by folding the other side of the bottom plate 70 at a height into a horizontal state above the bottom plate 70. The outer track plate 90 is formed with an opening 91 for enclosing the inner track plate 80. A circulation path 92 is formed between the inner and outer track plates 80 and 90. One end of the opening 91 of the outer track plate corresponding to the tip 81 of the inner track plate 80 is formed with a second positioning point 93. The other end of the opening 91 of the outer track plate has an M-like shape corresponding to the end of the M-like shape of the inner track plate 80, such that the other end of the opening 91 is formed with a middle projection 94 and two concave portions including a stroke point 95 and a card-out starting point 96.

The one-way blocks 77 are formed by pressing the bottom plate 70 into projecting portions, such that the circulation path 92 goes from the second positioning point 93 to the stroke point 95, the first positioning point 82, the card-out starting point 96, and the second positioning point 93 to form a one-way circulation.

When the metallic sliding slot structure 7 is assembled, the front end of the outer track plate 90 is first fit into the space below the engagement surface 36 at the front end of the allocation slot 34, and the notch 72 of the bottom plate 70 is aligned with the projection 37. Next, the bottom plate 70 is pressed downward to make the elastic engagement sheet 71 at the rear end thereof engage with the first slot 35. Thus, the metallic sliding slot structure 7 may be firmly positioned in the allocation slot 34 of the bottom seat, and the projection 37 can fill the notch 72 of the bottom plate.

According to the above-mentioned structure, because the circulation path 92 is the one-way circulation, the inserted memory card pushes the pushing piece 60 to move the guiding rod 62 from the second positioning point 93 to the stroke point 95, and is then pulled, by the elastic force of the spring 55, back to the first positioning point 82 for positioning. When the card is to be ejected, the memory card is also pushed. Then the guiding rod 62 is moved from the first positioning point 82 to the card-out starting point 96, and then pulled, by the elastic force of the spring 55, back to the initial second positioning point 93. Thus, the card-in/out function can be achieved.

In summary, the invention has the following advantages.

1. The metallic sliding slot structure 7 made of the metallic material can withstand wear, and the damage of sliding condition cannot occur easily after several times of usage. So, the reliability can be ensured.

2. The metallic sliding slot structure 7 is formed by folding and pressing the metallic plate, so the manufacturing processes can be easily controlled with high precision, and the manufacturing processes can be simplified and the cost can be reduced.

3. The metallic sliding slot structure 7 made of the metallic material has the metallic intensity better than the structure made of the plastic material. So, only the thin plate pressing process has to be used. In addition, the overall area is smaller than that made of the plastic molding process, and the product can be miniaturized.

Figure 9:
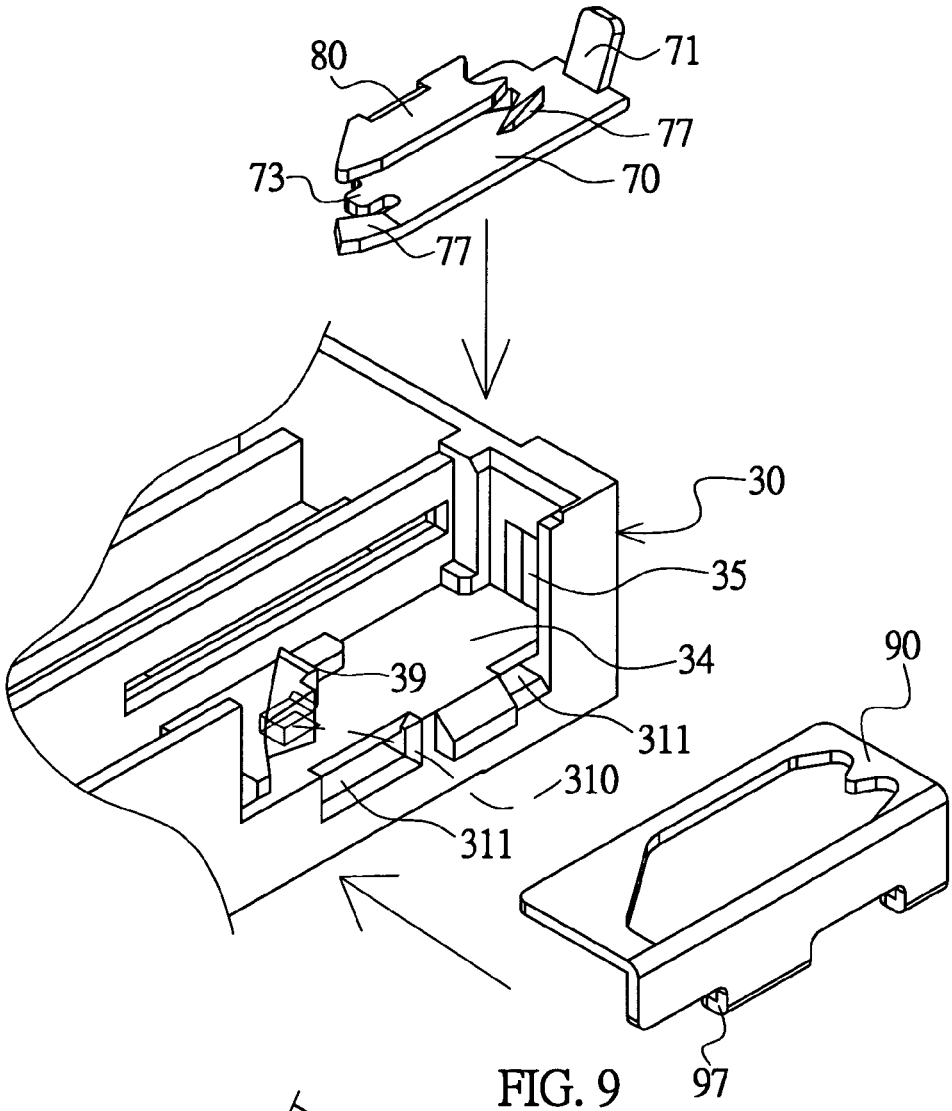
FIG. 9 is a pictorially exploded view showing a metallic sliding slot structure and an allocation slot according to a second embodiment of the invention.
Figure 10:
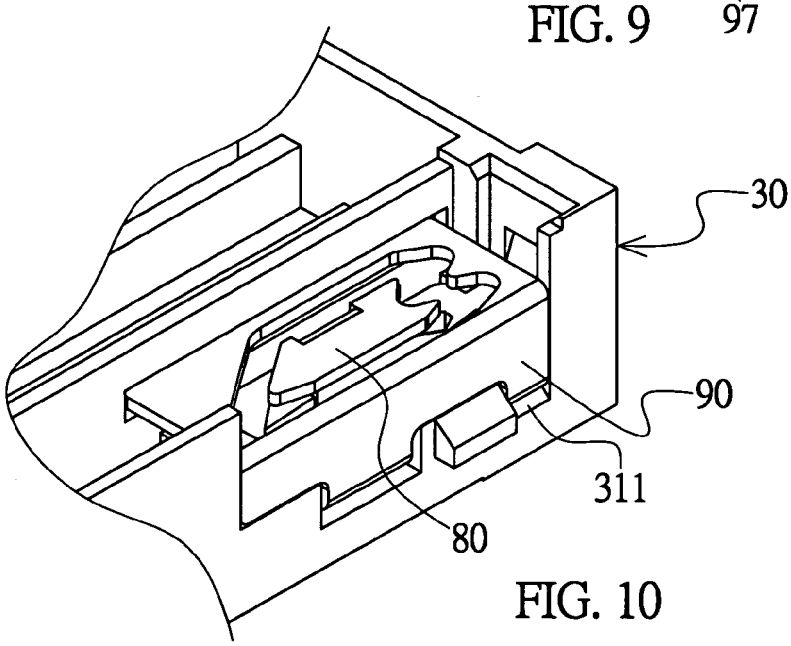
FIG. 10 is a pictorially assembled view showing the metallic sliding slot structure and the allocation slot according to the second embodiment of the invention.

As shown in FIGS. 9 and 10, the second embodiment of the invention is almost the same as the first embodiment except that the inner track plate 80 and the bottom plate 70 of this embodiment are integrally formed by way of pressing. The inner track plate 80 is formed by folding one side of the bottom plate 70 at a height into a state above the bottom plate 70. The front end of the bottom plate 70 is formed with a projection 73. The allocation slot 34 is formed with a supporting block 39, a transversal second slot 310 and a third slot 311. The projection 73 of the bottom plate is first fit into the second slot 310 and then pressed down to make the elastic engagement sheet 71 engage with the first slot 35. The inner track plate 80 can rest against the supporting block 39. The front view of the outer track plate 90 becomes an L shape. The bottom of the outer track plate 90 is formed with two horizontal engagement blocks 97 to be engaged with the third slot 311 of the allocation slot 34.

Figure 11:
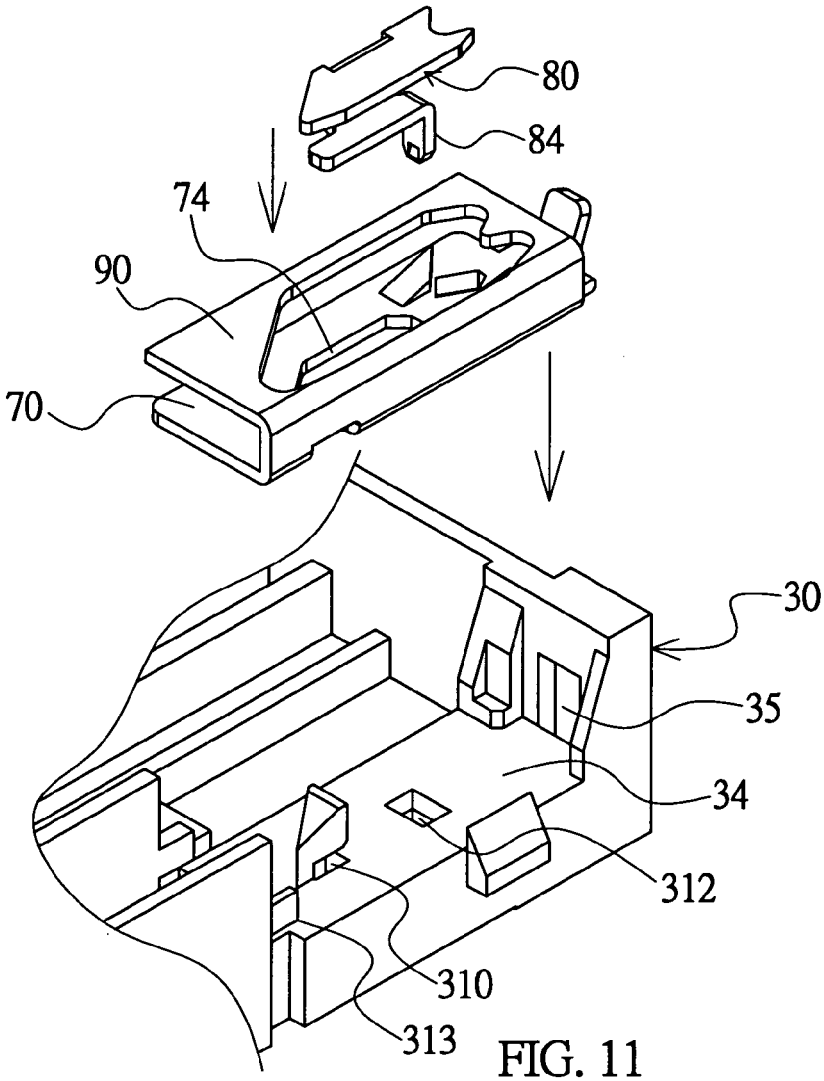
FIG. 11 is a pictorially exploded view showing a metallic sliding slot structure and an allocation slot according to a third embodiment of the invention.
Figure 12:
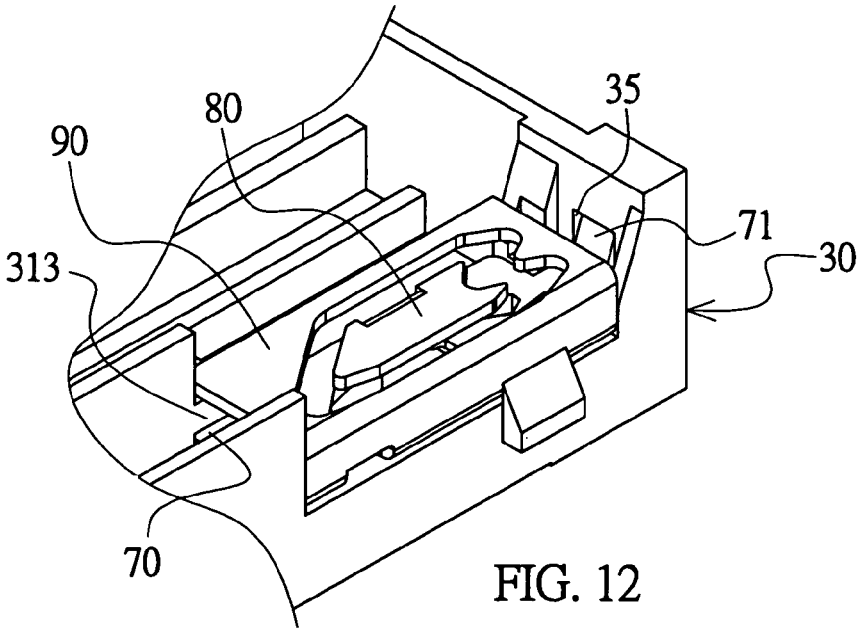
FIG. 12 is a pictorially assembled view showing the metallic sliding slot structure and the allocation slot according to the third embodiment of the invention.

As shown in FIGS. 11 and 12, the third embodiment of the invention is almost the same as the first embodiment except that the outer track plate 90 and the bottom plate 70 of this embodiment are integrally pressed into a ⊏ shape. The outer track plate 90 is formed by folding one side of the bottom plate 70 at a height into a state above the bottom plate 70. The allocation slot 34 of the bottom seat is formed with a transversal second slot 310 and a longitudinal hole 312. Two sides of the front end of the allocation slot 34 are formed with engagement surfaces 313 lower than those of the first embodiment. The bottom plate 70 has an opening 74. The bottom end of the inner track plate 80 is formed with an L-shaped engagement portion 84. During the assembly, the front end of the bottom plate 70 is fit below the engagement surface 313, and the bottom plate 70 is pressed down to make the elastic engagement sheet 71 engage with the first slot 35. Next, the engagement portion 84 of the inner track plate 80 passes through the opening 74 of the bottom plate and engages with the second slot 310 and the hole 312 of the allocation slot 34.

Figure 13:
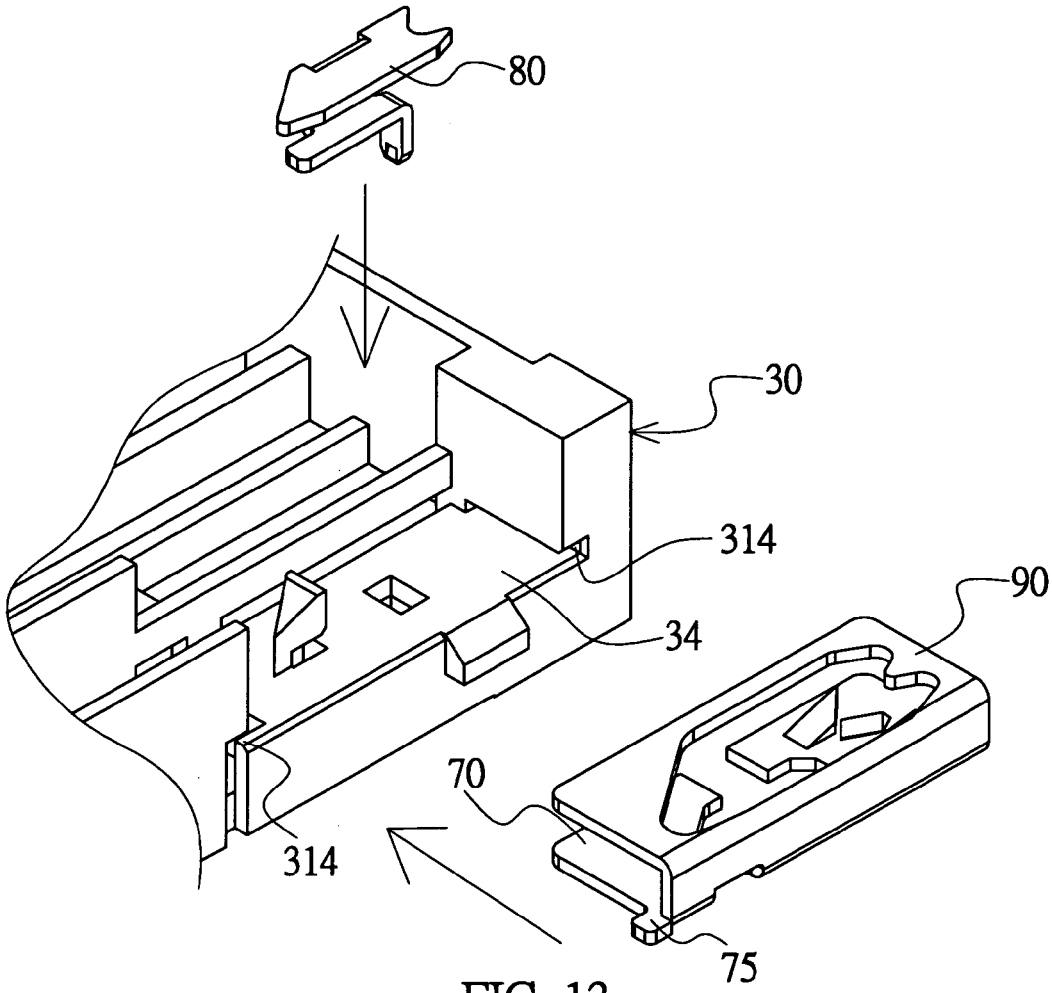
FIG. 13 is a pictorially exploded view showing a metallic sliding slot structure and an allocation slot according to a fourth embodiment of the invention.
Figure 14:
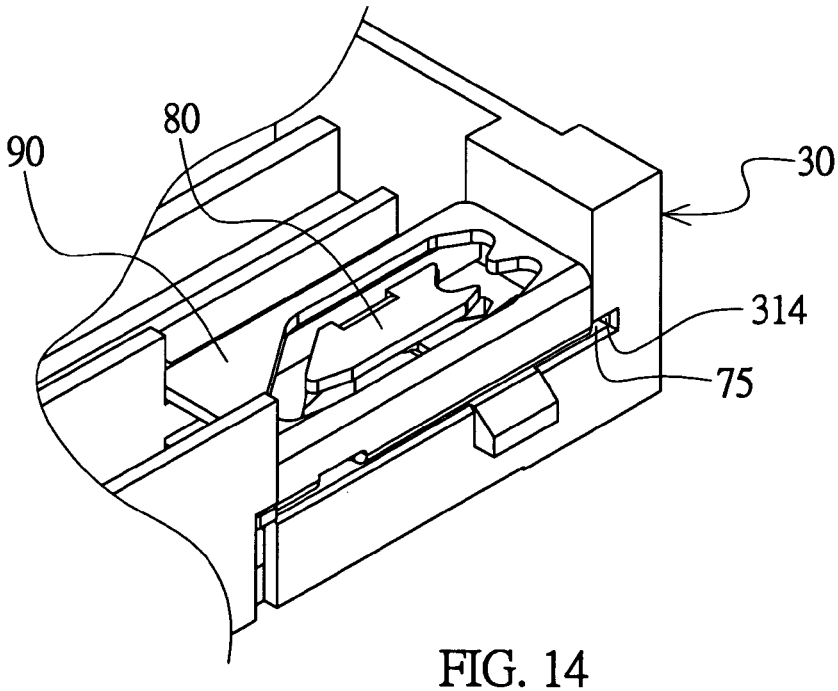
FIG. 14 is a pictorially assembled view showing the metallic sliding slot structure and the allocation slot according to the fourth embodiment of the invention.

As shown in FIGS. 13 and 14, the fourth embodiment of the invention is almost the same as the third embodiment except that the outer track plate 90 and the bottom plate 70 of this embodiment are transversally assembled in the allocation slot 34, the front and rear ends of the bottom plate 70 are formed with a flange 75, and the front and rear ends of the allocation slot 34 corresponding to the flange 75 of the bottom plate 70 are formed with a transversal fourth slot 314 to be engaged with the flange 75.

Figure 15:
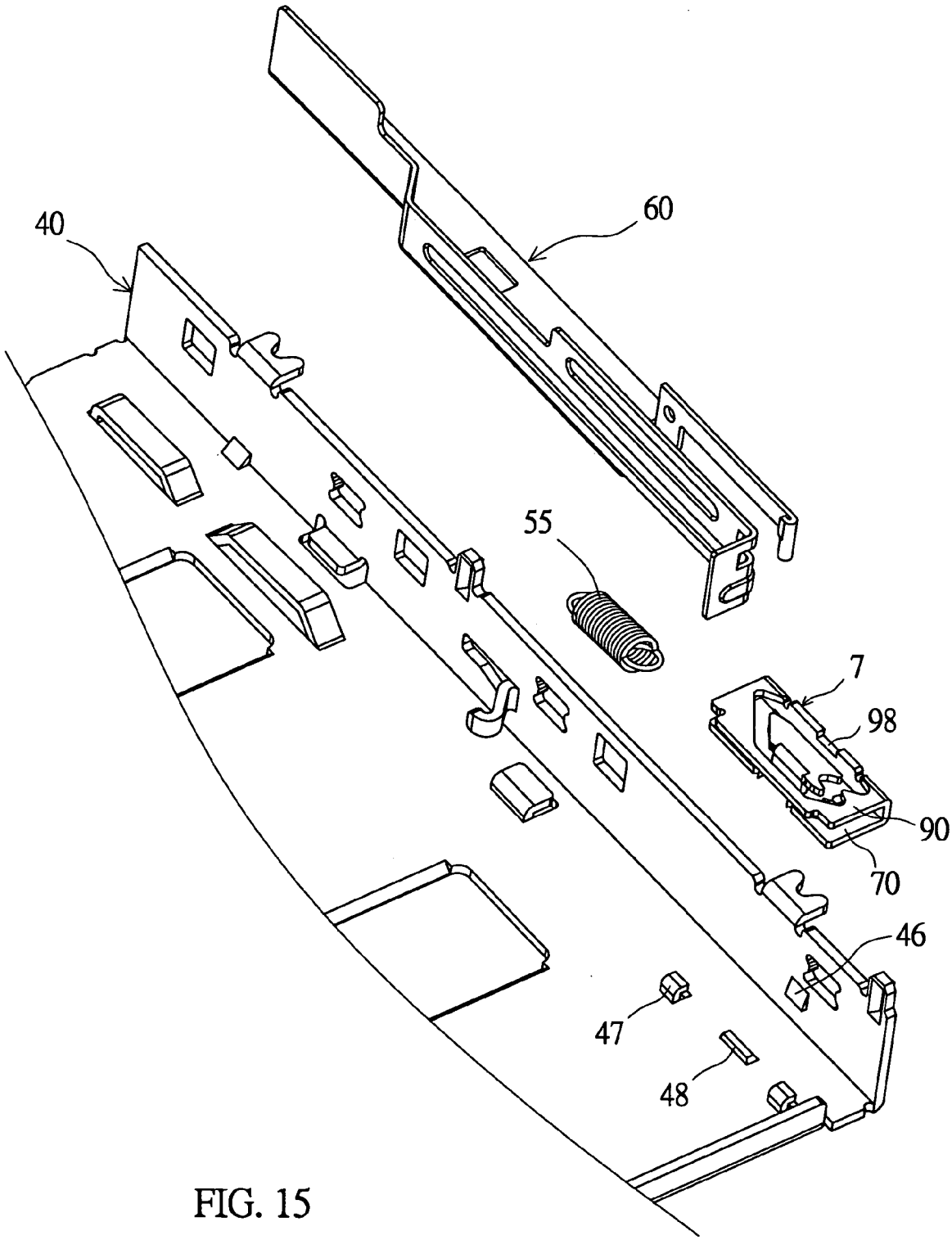
FIG. 15 is a pictorially exploded view showing a metallic sliding slot structure and an upper cover according to a fifth embodiment of the invention.
Figure 16:
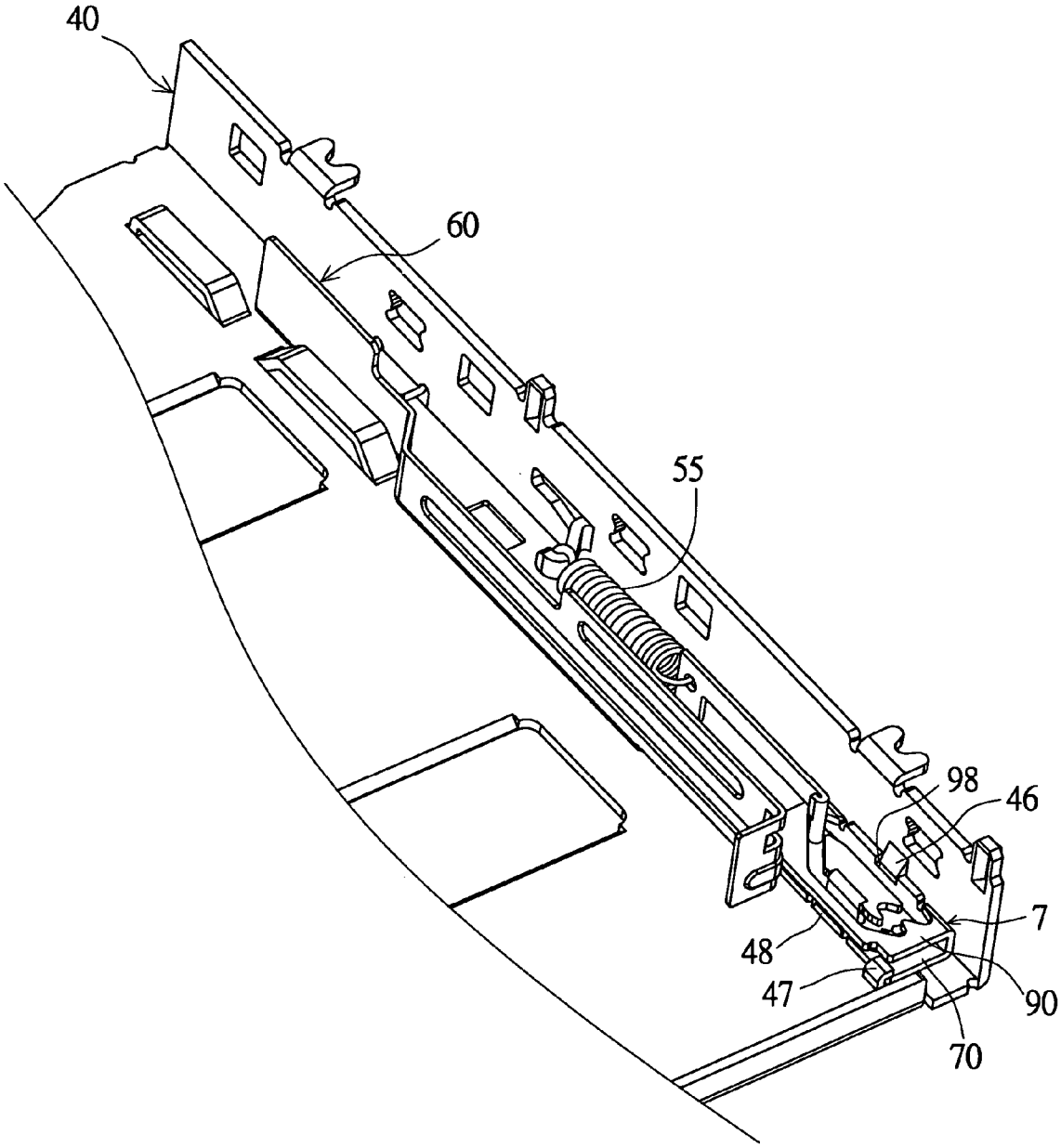
FIG. 16 is a pictorially assembled view showing the metallic sliding slot structure and the upper cover according to the fifth embodiment of the invention.
Figure 17:
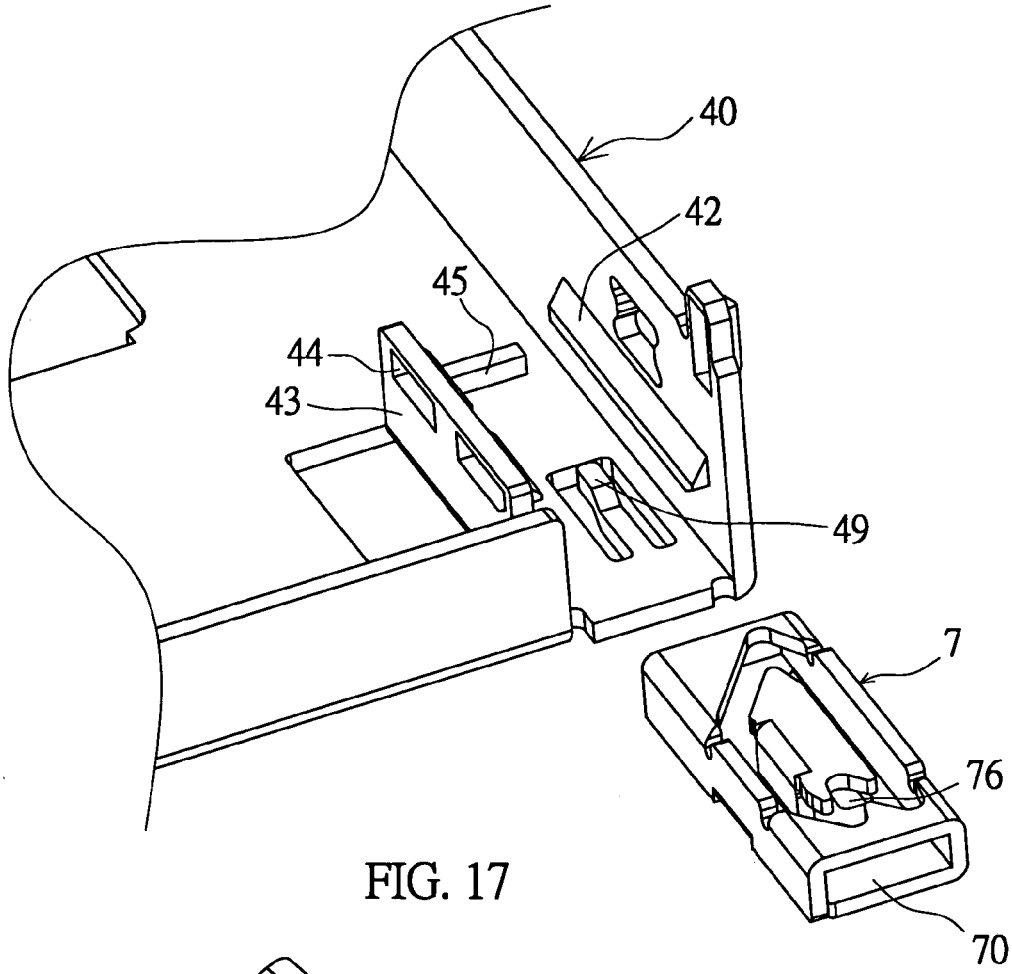
FIG. 17 is a pictorially exploded view showing a metallic sliding slot structure and an upper cover according to a sixth embodiment of the invention.
Figure 19:
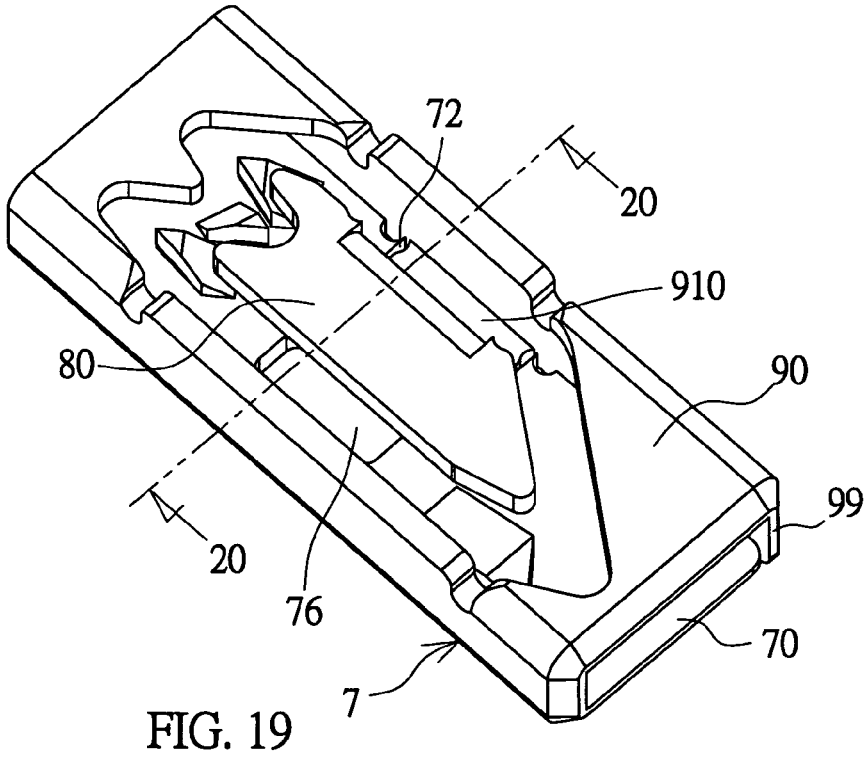
FIG. 19 is a pictorial view showing the metallic sliding slot structure according to the sixth embodiment of the invention.
Figure 18:
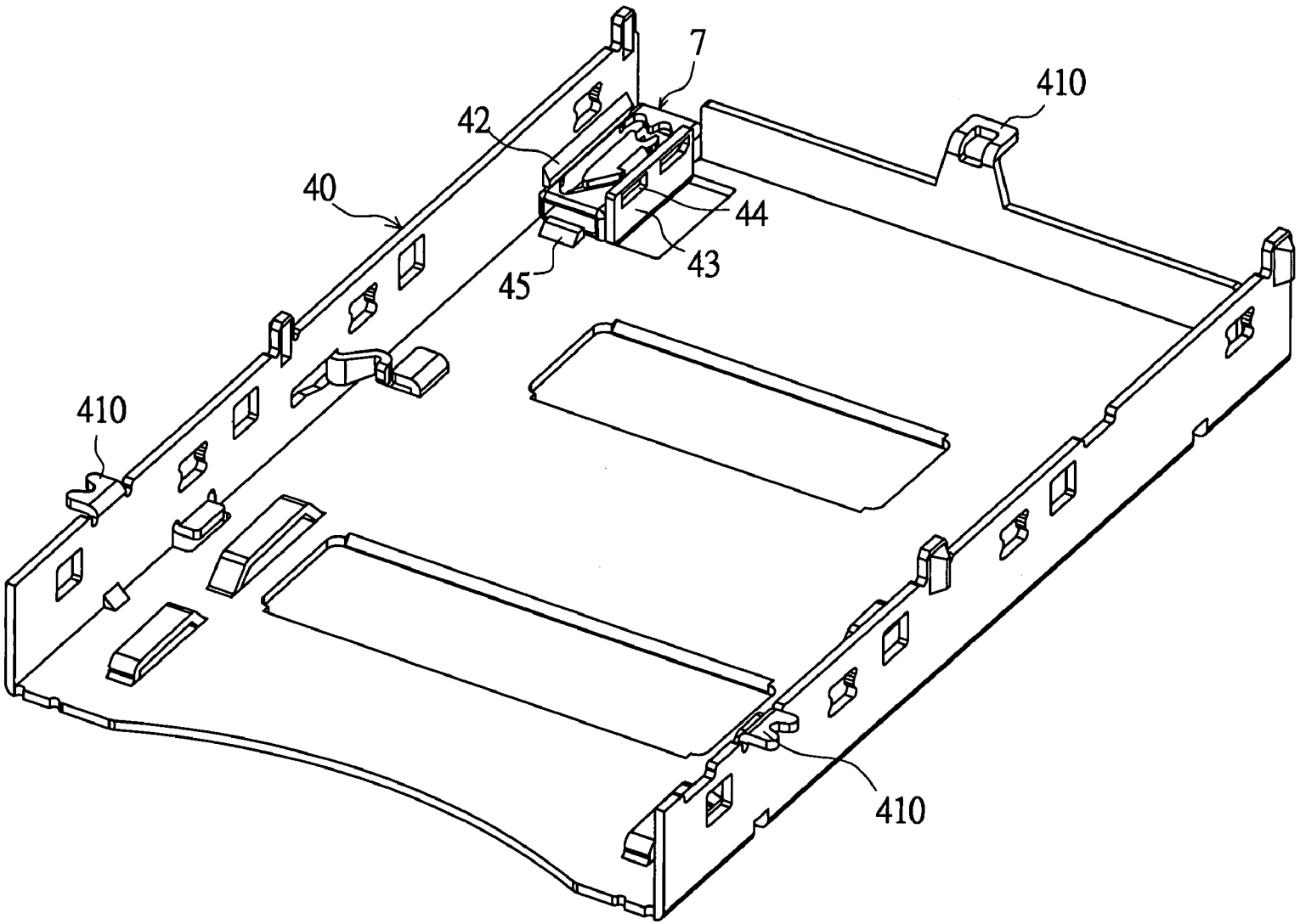
FIG. 18 is a pictorially assembled view showing the metallic sliding slot structure and the upper cover according to the sixth embodiment of the invention.

As shown in FIGS. 15 and 16, the fifth embodiment of this invention is almost the same as the first embodiment, which is formed by folding a metallic plate, except that the metallic sliding slot structure 7 of this embodiment is positioned in the upper cover 40. The middle of the outer side of the outer track plate 90 is formed with a recess 98. The lateral side of the upper cover 40 is formed with an engagement block 46, and the inner surface of the upper cover 40 is formed with two hooks 47 and one projection 48. During the assembly, the bottom plate 70 of the metallic sliding slot structure 7 engaging with the hook 47 is pressed down, and the engagement block 46 engages with the recess 98.

As shown in FIGS. 17 to 20, the sixth embodiment of the invention is almost the same as the fifth embodiment except that a vertical plate 99 is formed by folding the inner side of the outer track plate 90 of the metallic sliding slot structure 7 downward in this embodiment, such that the front view of the metallic sliding slot structure 7 becomes a rectangular structure. A horizontal plate 910 for filling the notch 72 of the bottom plate 70 is formed by bending the middle of the vertical plate 99 by 90 degrees. The bottom plate 70 has an engagement hole 76. The lateral side of the upper cover 40 is pressed to form an engagement rib 42, and the inner surface of the upper cover 40 is pressed to form a stop rib 45 and an elastic sheet 49, and pressed and folded into a vertical plate 43. The vertical plate 43 is pressed to form an engagement rib 44 corresponding to the engagement rib 42. The lower edge of the upper cover 40 is formed with three bonding pads 410. During the assembly, the metallic sliding slot structure 7 is pushed from the rear side of the upper cover 40, and the two sides of the top of the metallic sliding slot structure 7 are respectively engaged with the engagement ribs 42 and 44. The front end of the bottom plate 70 may be stopped by the stop rib 45, and the elastic sheet 49 bounces and engages with the engagement hole 76 of the bottom plate 70.

Figure 21:
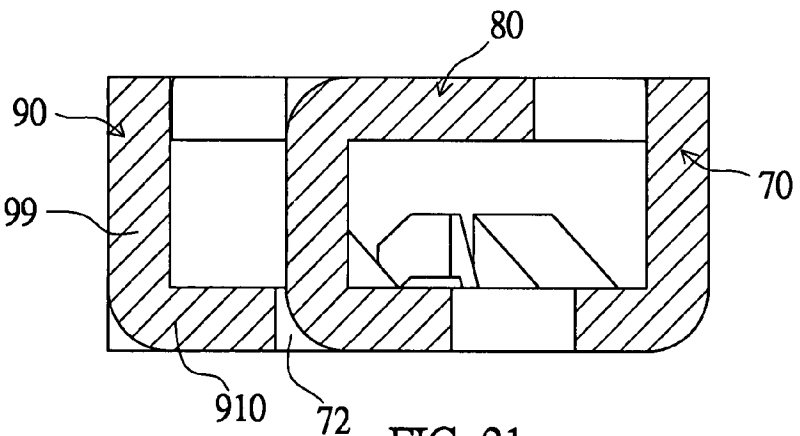
FIG. 21 is a cross-sectional view showing a metallic sliding slot structure according to a seventh embodiment of the invention.

As shown in FIG. 21, the seventh embodiment of the invention is almost the same as the sixth embodiment except that the folding directions of the inner track plate 80 and the outer track plate 90 are opposite to those of the sixth embodiment.

Figure 22:
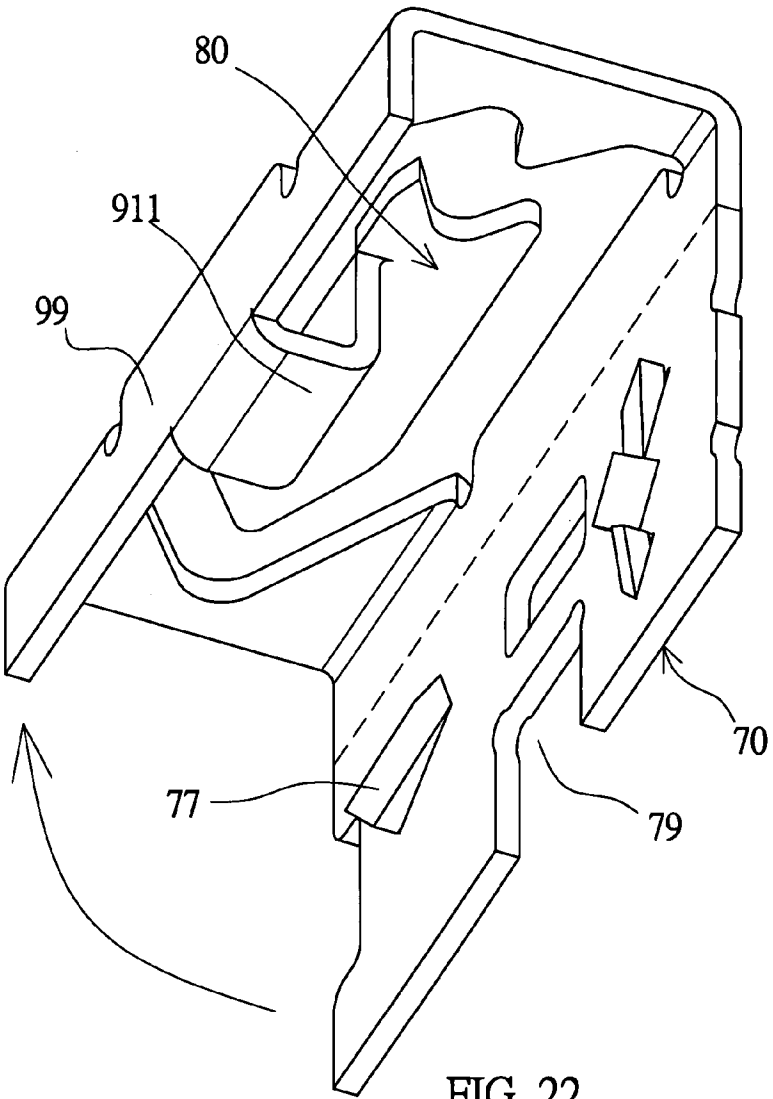
FIG. 22 is a pictorially developed view showing a metallic sliding slot structure according to an eighth embodiment of the invention.
Figure 20:
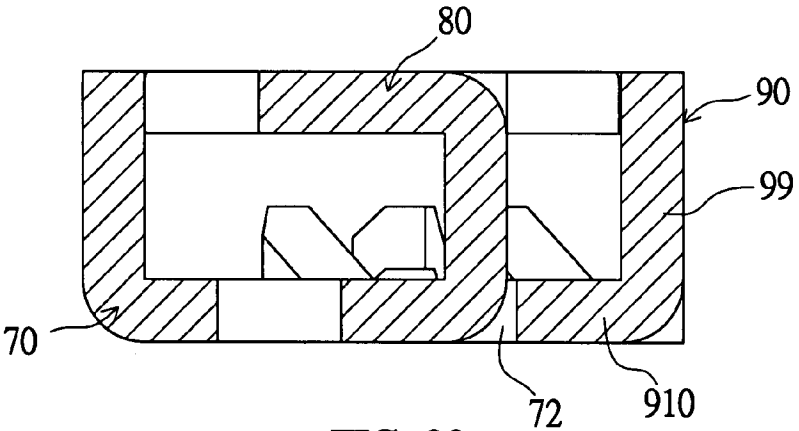
FIG. 20 is a cross-sectional view showing the metallic sliding slot structure according to the sixth embodiment of the invention.
Figure 23:
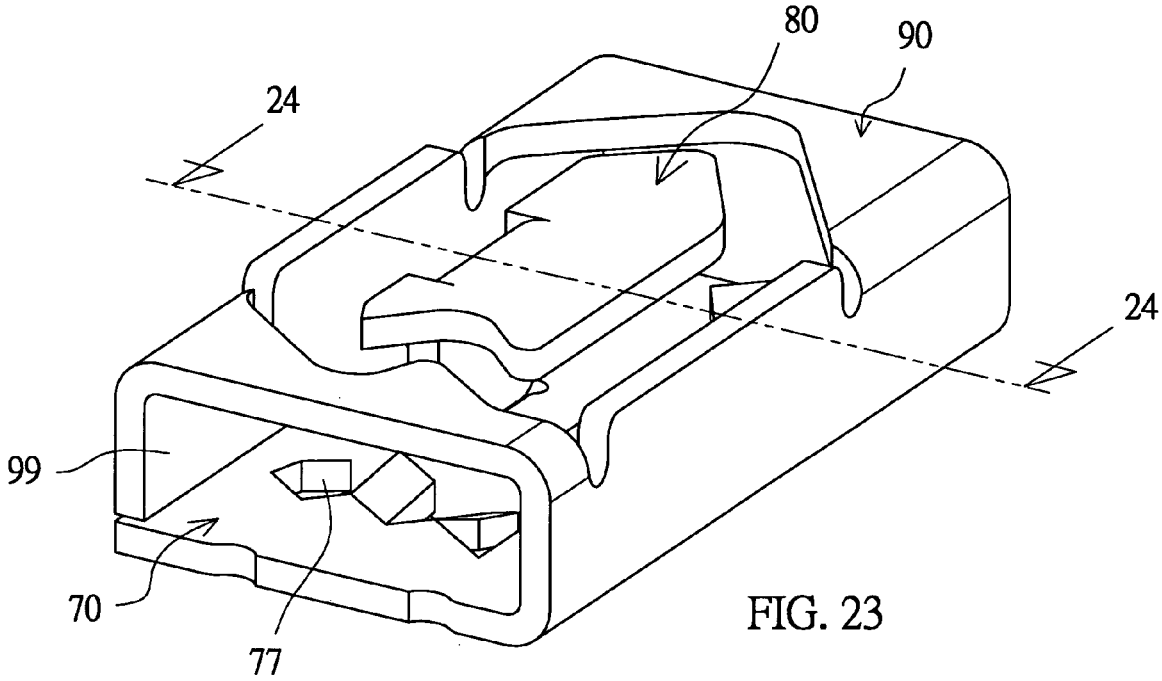
FIG. 23 is a pictorial view showing the metallic sliding slot structure according to the eighth embodiment of the invention.
Figure 24:
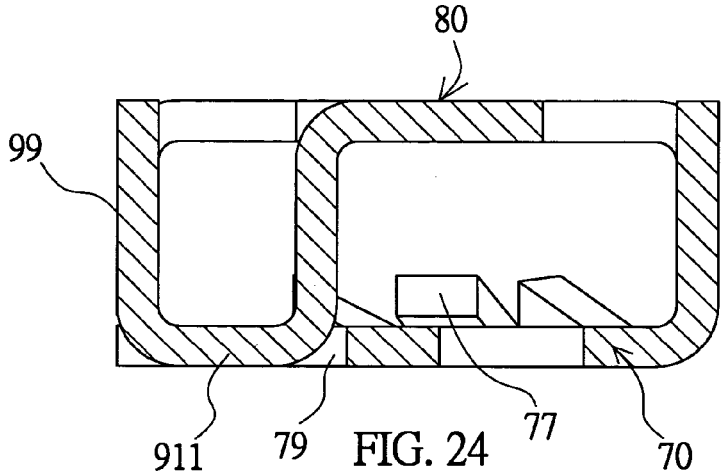
FIG. 24 is a cross-sectional view showing the metallic sliding slot structure according to the eighth embodiment of the invention.

As shown in FIGS. 22 to 24, the eighth embodiment of this embodiment is almost the same as the sixth embodiment, which is integrally formed by pressing a metallic plate, except that the inner track plate 80 of this embodiment is connected to the outer track plate 90. That is, the outer track plate 90 above the bottom plate 70 is formed by folding one side of the bottom plate 70, and a vertical plate 99 is formed by folding the other side of the bottom plate 70. The bottom edge of the middle of the vertical plate 99 is connected to an L-shaped plate 911. The inner track plate 80 is connected to the top of the L-shaped plate 911. The bottom plate is similarly pressed to form multiple one-way engagement blocks 77 and a notch 79. The notch 79 can engage with the horizontal plate surface of the L-shaped plate 911.

Figure 25:
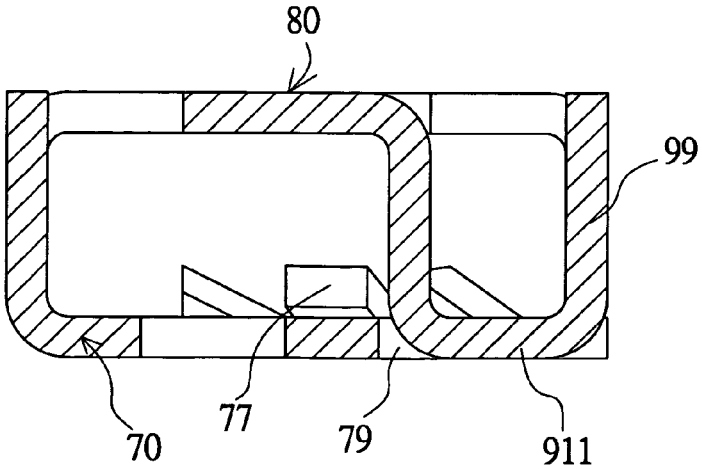
FIG. 25 is a cross-sectional view showing a metallic sliding slot structure according to a ninth embodiment of the invention.

As shown in FIG. 25, the ninth embodiment of this invention is almost the same as the eighth embodiment except that the folding directions of the inner track plate 80 and the outer track plate 90 are opposite to those of the eighth embodiment.

Figure 28:
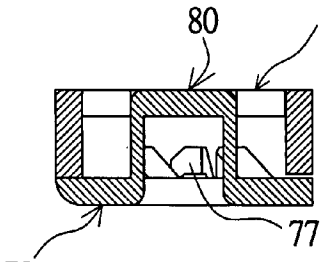
FIG. 28 is a cross-sectional view showing the metallic sliding slot structure according to the tenth embodiment of the invention.
Figure 26:
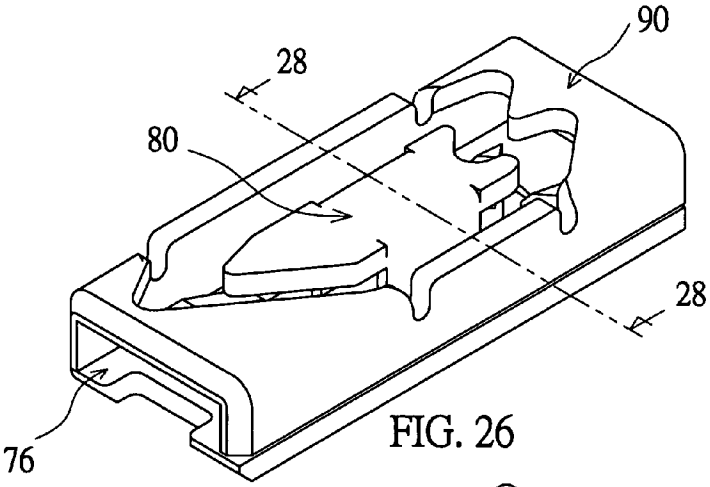
FIG. 26 is a pictorial view showing a metallic sliding slot structure according to a tenth embodiment of the invention.
Figure 27:
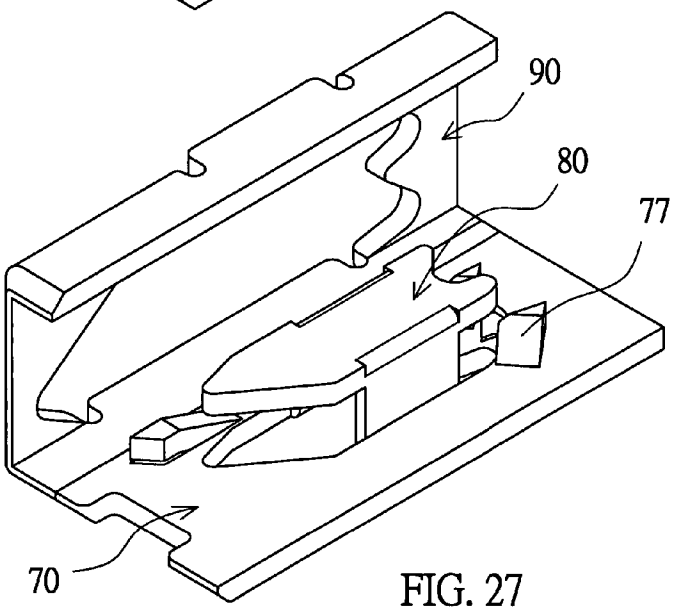
FIG. 27 is a pictorially developed view showing the metallic sliding slot structure according to the tenth embodiment of the invention.

As shown in FIGS. 26 to 28, the tenth embodiment of this invention is almost the same as the sixth embodiment, which is integrally formed by pressing a metallic plate, except that the inner track plate 80 of this embodiment is extruded by a height from the middle of the bottom plate 70. Tow edges of the middle of the inner track plate 80 are connected to the bottom plate, and the other portions are torn and separated from the bottom plate 70. Similarly, the bottom plate is pressed to form multiple one-way engagement blocks 77.

Figure 29:
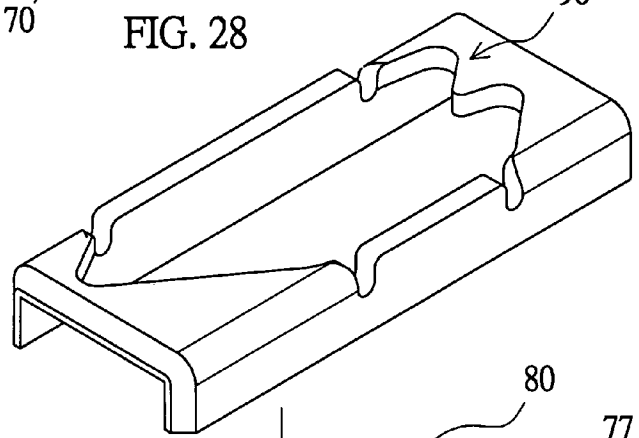
FIG. 29 is a pictorially exploded view showing a metallic sliding slot structure according to an eleventh embodiment of the invention.
Figure 29:
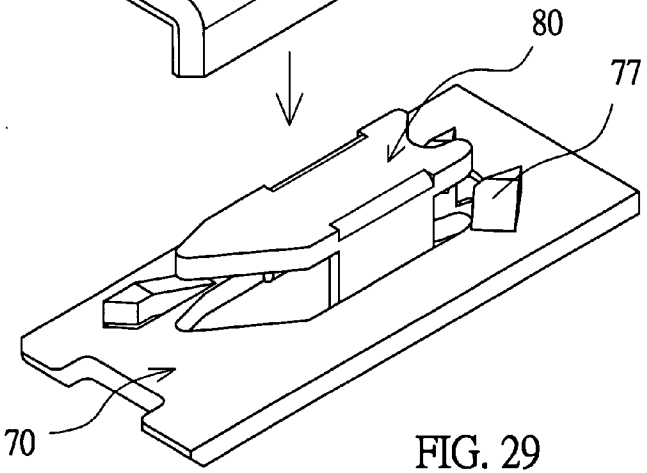

As shown in FIG. 29, the eleventh embodiment of the invention is almost the same as the tenth embodiment except that this embodiment has two parts. That is, the bottom plate 70 and the outer track plate 90 are manufactured separately and then combined together. The combination of the two parts may be easily designed, and detailed descriptions thereof will be omitted.

Figures 30, 31, 32, 33:
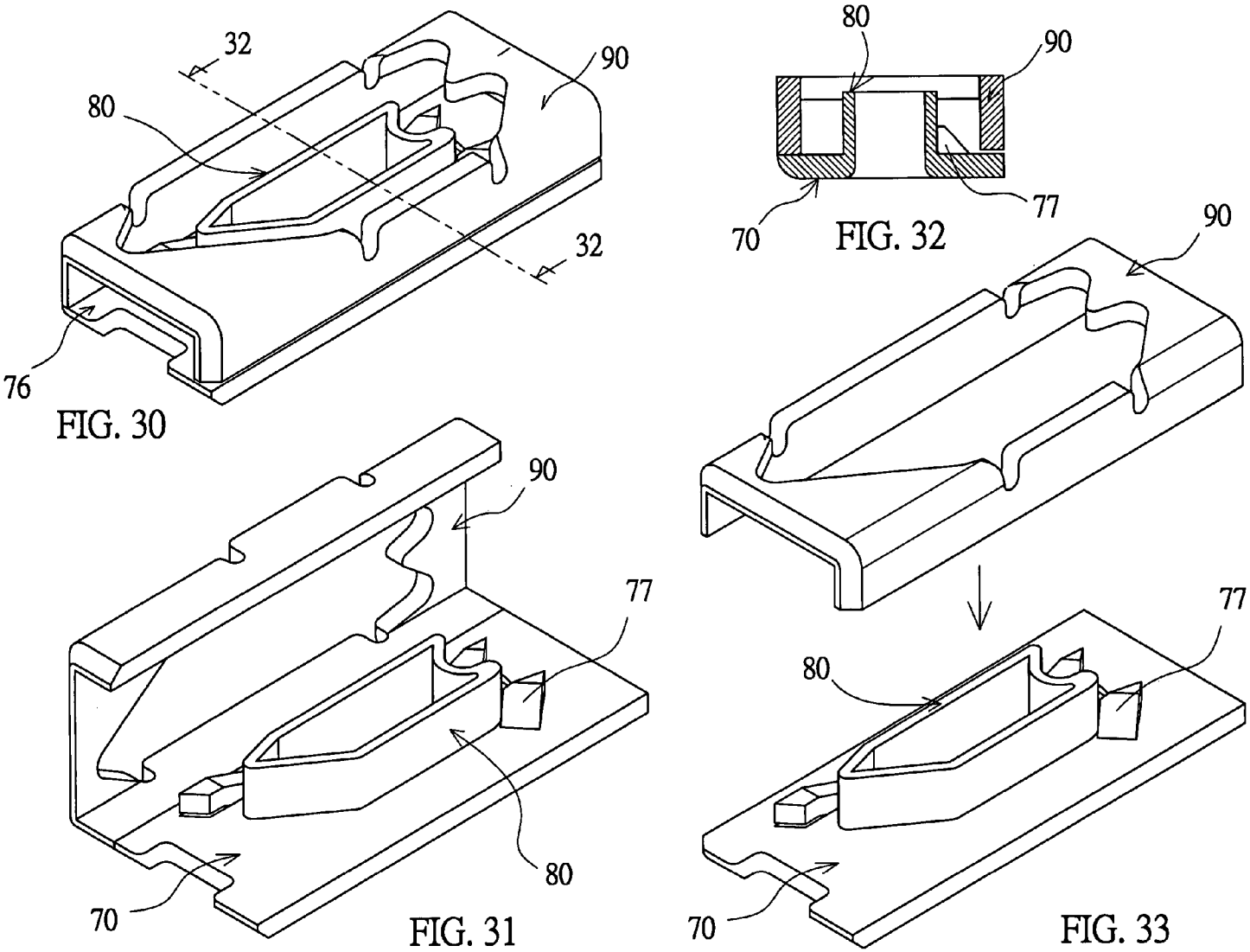
FIG. 30 is a pictorial view showing a metallic sliding slot structure according to a twelfth embodiment of the invention.
FIG. 31 is a pictorially developed view showing the metallic sliding slot structure according to the twelfth embodiment of the invention.
FIG. 32 is a cross-sectional view showing the metallic sliding slot structure according to the twelfth embodiment of the invention.
FIG. 33 is a pictorially exploded view showing a metallic sliding slot structure according to a thirteenth embodiment of the invention.

As shown in FIGS. 30 to 32, the twelfth embodiment of this invention is almost the same as the tenth embodiment, which is integrally formed by pressing a metallic plate, except that the inner track plate 80 of this embodiment is extruded by a height from the middle of the bottom plate 70. The inner track plate 80 surrounding a cavity is connected to the bottom plate 70.

As shown in FIG. 33, the thirteenth embodiment of this invention is almost the same as the twelfth embodiment except that this embodiment has two parts. That is, the bottom plate 70 and the outer track plate 90 are manufactured separately and then combined together. The combination of the two parts may be easily designed, and detailed descriptions thereof will be omitted.

Figure 36:
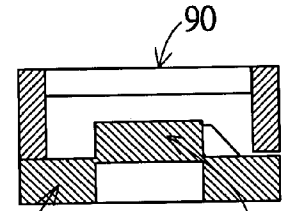
FIG. 36 is a cross-sectional view showing the metallic sliding slot structure according to the fourteenth embodiment of the invention.
Figure 34:
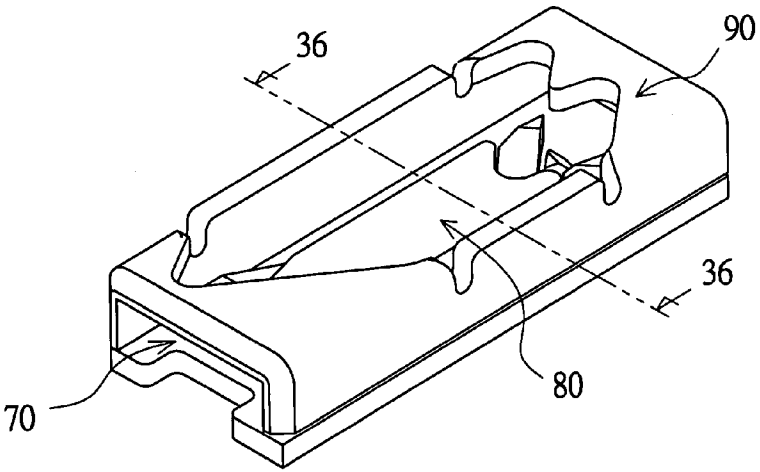
FIG. 34 is a pictorial view showing a metallic sliding slot structure according to a fourteenth embodiment of the invention.
Figure 35:
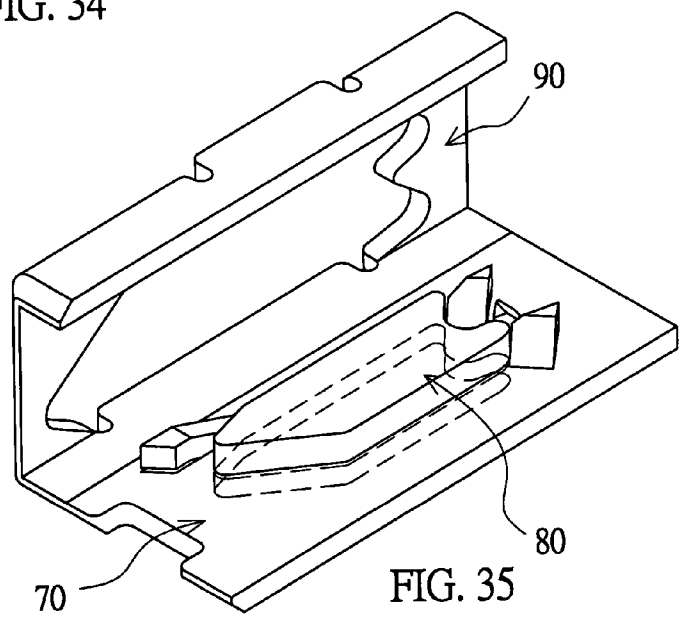
FIG. 35 is a pictorially developed view showing the metallic sliding slot structure according to the fourteenth embodiment of the invention.

As shown in FIGS. 34 to 36, the fourteenth embodiment of this invention is almost the same as the tenth embodiment, which is integrally formed by pressing a metallic plate, except that the inner track plate 80 is pressed upward from the bottom plate 70 to form a step-like platform.

Figure 37:
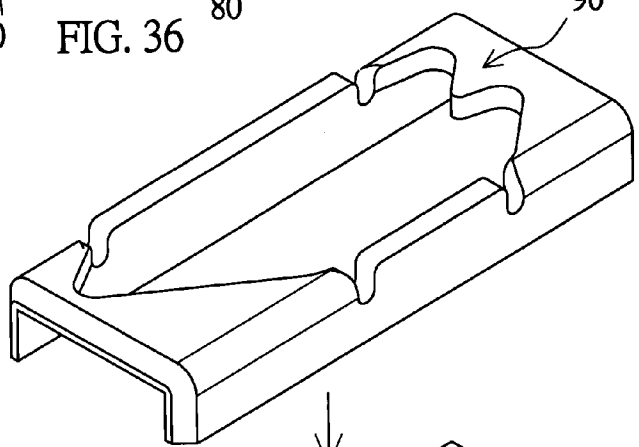
FIG. 37 is a pictorially exploded view showing a metallic sliding slot structure according to a fifteenth embodiment of the invention.
Figure 37:
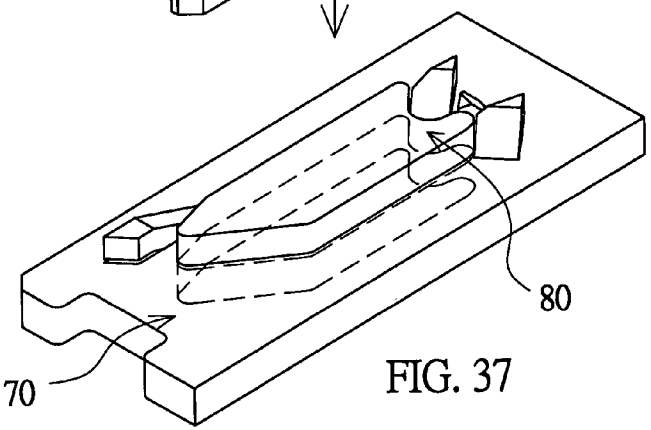

As shown in FIG. 37, the fifteenth embodiment of this invention is almost the same as the fourteenth embodiment except that this embodiment has two parts. That is, the bottom plate 70 and the outer track plate 90 are manufactured separately and then combined together. The combination of the two parts may be easily designed, and detailed descriptions thereof will be omitted.

Figure 40:
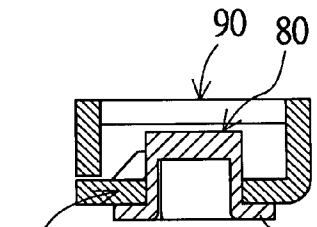
FIG. 40 is a cross-sectional view showing the metallic sliding slot structure according to the sixteenth embodiment of the invention.
Figure 38:
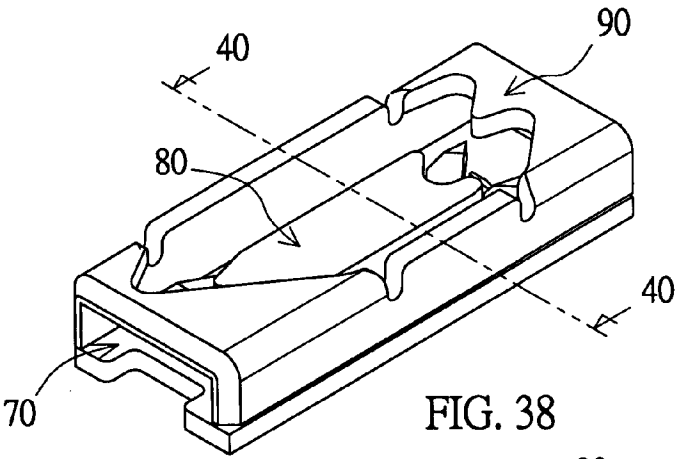
FIG. 38 is a pictorially assembled view showing a metallic sliding slot structure according to a sixteenth embodiment of the invention.
Figure 39:
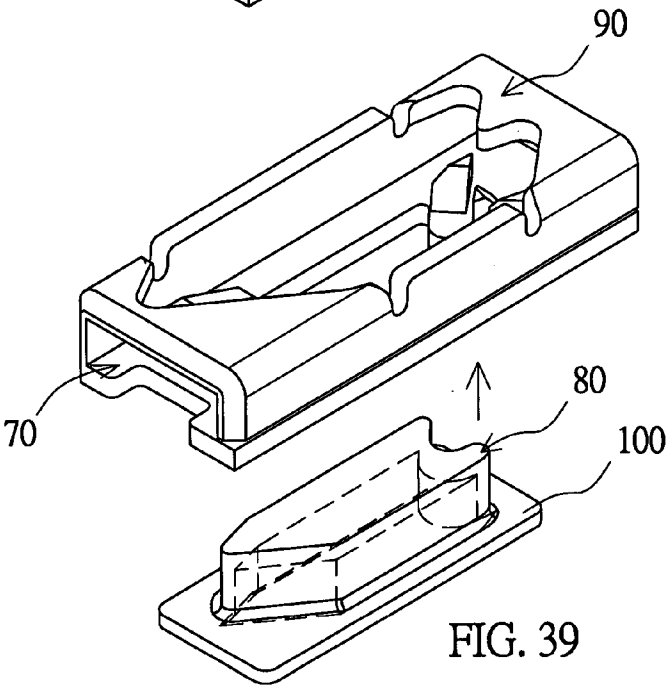
FIG. 39 is a pictorially exploded view showing the metallic sliding slot structure according to the sixteenth embodiment of the invention.

As shown in FIGS. 38 to 40, the sixteenth embodiment of this invention is almost the same as the tenth embodiment except that the bottom plate 70 and the outer track plate 90 are integrally formed by pressing a metallic plate, while the inner track plate 80 is formed by extruding another metallic plate. That is, the hollow inner track plate 80 is formed by extruding the metallic plate at the middle portion.

Figure 41:
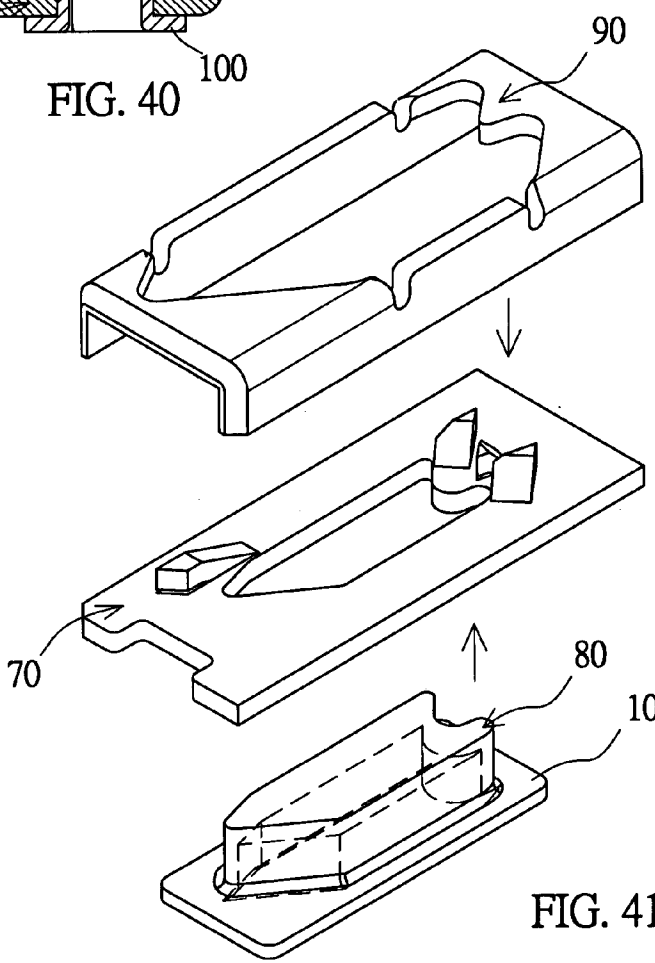
FIG. 41 is a pictorially exploded view showing a metallic sliding slot structure according to a seventeenth embodiment of the invention.

As shown in FIG. 41, the fifteenth embodiment of this invention is almost the same as the sixteenth embodiment except that this embodiment has three parts. That is, the bottom plate 70, the inner track plate 80 and the outer track plate 90 are manufactured separately and then combined together. The combination of the three parts may be easily designed, and detailed descriptions thereof will be omitted.

Figure 42:
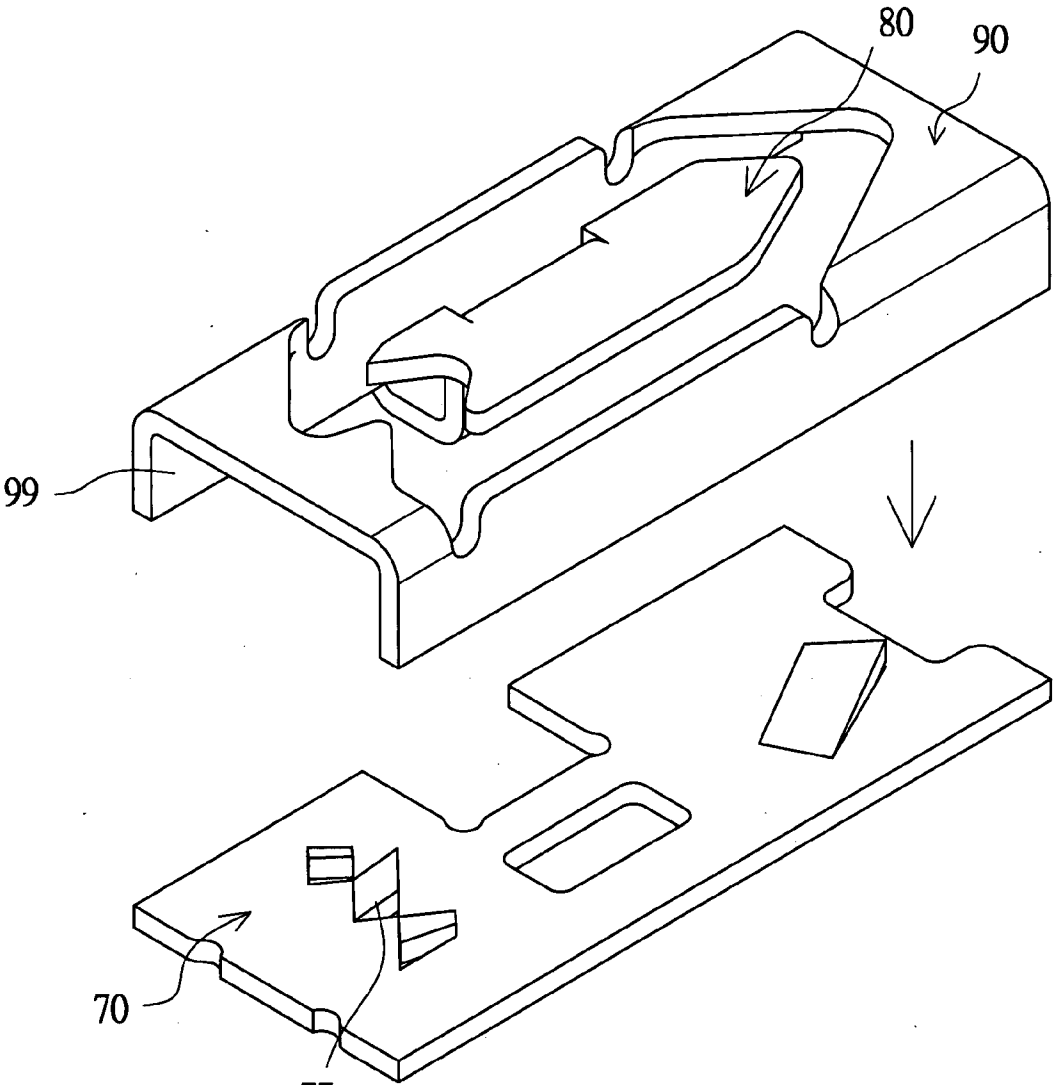
FIG. 42 is a pictorially exploded view showing a metallic sliding slot structure according to an eighteenth embodiment of the invention.

As shown in FIG. 42, the fifteenth embodiment of this invention is almost the same as the eighth embodiment except that this embodiment has two parts. That is, the bottom plate 70 and the outer track plate 90 are manufactured separately and then combined together. The combination of the two parts may be easily designed, and detailed descriptions thereof will be omitted.

While the invention has been described by way of examples and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A metallic sliding slot structure for an electrical connector, the electrical connector comprising a base in which the metallic sliding slot structure is positioned, the metallic sliding slot structure being formed by folding and pressing a metallic plate, the metallic sliding slot structure comprising:

a bottom plate;

an inner track plate disposed above the bottom plate, the inner track plate having one end formed with a tip and the other end formed into an M-like shape to form a concave first positioning point;

an outer track plate having an opening for enclosing the inner track plate, wherein a circulation path is formed between the inner and outer track plates, and a second positioning point corresponding to the tip of the inner track plate is defined in the opening of the outer track plate; and at least one one-way block formed by pressing the bottom plate, such that the circulation path goes from the second positioning point to the first positioning point and then back to the second positioning point to form a one-way circulation.

2. The metallic sliding slot structure according to claim 1, wherein one end of the opening of the outer track plate has a M-like shape corresponding to one end of the M-like shape of the inner track plate, such that the other end of the opening is formed with one middle projection and two concave portions.

3. The metallic sliding slot structure according to claim 1, wherein the inner track plate and the bottom plate are integrally formed by way of pressing and fixed to the base, the inner track plate above the bottom plate is formed by folding one side of the bottom plate, and the outer track plate has an L shape and is additionally engaged with the base.

4. The metallic sliding slot structure according to claim 1, wherein:

the inner track plate is formed by pressing and extruding a middle of the bottom plate by a height; and two edges of a middle of the inner track plate are connected to the bottom plate, and other portions of the inner track plate are torn and separated from the bottom plate.

5. The metallic sliding slot structure according to claim 1, wherein the inner track plate is formed by pressing and extruding a middle of the bottom plate by a height, and the inner track plate surrounding a cavity is connected to the bottom plate.

6. The metallic sliding slot structure according to claim 1, wherein the inner track plate is pressed upward from the bottom plate to form a step-like platform.

7. The metallic sliding slot structure according to claim 1, wherein the inner track plate is hollow and is formed by extruding a middle of another metallic plate.

8. The metallic sliding slot structure according to claim 1, wherein:

one side of the outer track plate is folded downward to form a vertical plate;

an L-shaped plate connected to the vertical plate at a portion near a middle of the vertical plate is formed; and the inner track plate is connected to a top of the L-shaped plate.

9. The metallic sliding slot structure according to claim 8, wherein the outer track plate is disposed above the bottom plate by folding one side of the bottom plate.

10. The metallic sliding slot structure according to claim 1, wherein the inner track plate above the bottom plate is formed by folding one side of the bottom plate, and the outer track plate above the bottom plate is formed by folding the other side of the bottom plate.

11. The metallic sliding slot structure according to claim 10, wherein the inner track plate above the bottom plate is formed by tearing and folding the one side of the bottom plate, such that the bottom plate is formed with a notch, and the base has a projection to fill the notch of the bottom plate.

12. The metallic sliding slot structure according to claim 11, wherein an inner side of the outer track plate of the metallic sliding slot structure is pressed down to form a vertical plate such that a front view of the metallic sliding slot structure becomes a rectangular structure, and a portion near a middle of the vertical plate is bent by 90 degrees to form a horizontal plate to fill the notch of the bottom plate.

13. The metallic sliding slot structure according to claim 1, wherein the base is formed by the bottom plate and an upper cover covering over the bottom plate, and the metallic sliding slot structure is positioned on an inner surface of the upper cover.

14. The metallic sliding slot structure according to claim 13, wherein an outer side of the outer track plate of the metallic sliding slot structure is formed with a recess, the inner surface of the upper cover is formed with at least one hook for hooking a bottom surface of the metallic sliding slot structure, and a lateral side of the upper cover is formed with an engagement block for engaging with the recess of the metallic sliding slot structure.

15. The metallic sliding slot structure according to claim 13, wherein:

the bottom plate of the metallic sliding slot structure is formed with an engagement hole;

a lateral side of the upper cover is pressed to form an engagement rib for engaging with a side of a top of the metallic sliding slot structure;

the inner surface of the upper cover is pressed to form a stop rib, an elastic sheet and a vertical plate, the vertical plate is pressed to form an engagement rib for engaging with the other side of the top of the metallic sliding slot structure;

a front end of the bottom plate is stopped by the stop rib; and the elastic sheet engages with the engagement hole of the bottom plate.

16. The metallic sliding slot structure according to claim 1, wherein the base has an allocation slot, and the metallic sliding slot structure is positioned in the allocation slot.

17. The metallic sliding slot structure according to claim 16, wherein a rear end of the bottom plate is formed with an elastic engagement sheet, a rear end of the allocation slot of the base has a slot for engaging with the elastic engagement sheet at the rear end of the bottom plate, and two sides of a front end of the allocation slot are formed with engagement surfaces to engage with a front end of the outer track plate.

18. The metallic sliding slot structure according to claim 16, wherein one end of the bottom plate is formed with an elastic engagement sheet, the other end of the bottom plate is formed with a projection, and the allocation slot of the base is correspondingly formed with two slots to be engaged with the elastic engagement sheet and the projection of the bottom plate, respectively.

19. The metallic sliding slot structure according to claim 16, wherein the outer track plate and the bottom plate are integrally pressed into a ⊏ shape and fixed to the base, and the inner track plate is additionally engaged with the base.

20. The metallic sliding slot structure according to claim 16, wherein the allocation slot of the base is formed with a transversal slot and a longitudinal hole, the bottom plate has an opening, and the inner track plate is formed with an L-shaped engagement portion, which passes through the opening of the bottom plate and is engaged with the transversal slot and the longitudinal hole of the allocation slot of the base.

* * * * *